US009605836B2

(12) United States Patent
Sharrah et al.

(10) Patent No.: US 9,605,836 B2
(45) Date of Patent: Mar. 28, 2017

(54) PORTABLE LIGHT HAVING A HOUSING INCLUDING A LOCK

(71) Applicant: STREAMLIGHT, INC., Eagleville, PA (US)

(72) Inventors: Raymond L. Sharrah, Collegeville, PA (US); Peter J. Ziegenfuss, Sellersville, PA (US); Cleatis A. Eichelberger, East Norriton, PA (US)

(73) Assignee: Streamlight, Inc., Eagleville, PA (US)

( * ) Notice: Subject to any disclaimer, the term of this patent is extended or adjusted under 35 U.S.C. 154(b) by 0 days.

(21) Appl. No.: 15/053,078

(22) Filed: Feb. 25, 2016

(65) Prior Publication Data

US 2016/0169483 A1 Jun. 16, 2016

Related U.S. Application Data

(62) Division of application No. 13/668,532, filed on Nov. 5, 2012, now Pat. No. 9,285,105.

(Continued)

(51) Int. Cl.
*F21V 15/01* (2006.01)
*F21V 21/084* (2006.01)

(Continued)

(52) U.S. Cl.
CPC ..... *F21V 15/01* (2013.01); *F21L 4/00* (2013.01); *F21L 15/02* (2013.01); *F21V 5/006* (2013.01);

(Continued)

(58) Field of Classification Search
CPC .... F21V 15/01; F21V 23/0414; F21V 21/084; F21V 23/003
See application file for complete search history.

(56) References Cited

U.S. PATENT DOCUMENTS 608,109 A 7/1898 Dow
1,443,106 A 1/1923 Walsh (Continued)

FOREIGN PATENT DOCUMENTS

DE 283441 4/1915
DE 8515726 8/1985

(Continued)

OTHER PUBLICATIONS

Adaro Tecnologia, SA, "Adalit L2000" web page and pages from brochure, www.adalit.es/EN/HAdalitL2000EN.html, Publicacion No. EP-DA-8/1, Emision: Agosto/ 06. Rev.0, printed Apr. 18, 2011, 2 pages.

(Continued)

*Primary Examiner* — Donald Raleigh
*Assistant Examiner* — Kevin Quarterman
(74) *Attorney, Agent, or Firm* — Clement A. Berard, Esq.; Dann, Dorfman, Herrell & Skillman, PC

(57) ABSTRACT

A portable light may comprise: a light housing having housing parts for enclosing a source of electrical power and supporting an electrical light source, a slide latch slidable on the light housing parts between latched and unlatched positions; a projection proximate the slide latch when the housing parts are adjacent; wherein when the slide latch is moved to the latched position, separation of the housing parts is prevented, and wherein when the slide latch is moved to the unlatched position, the housing parts can be separated. A tool may be needed to open the housing.

38 Claims, 13 Drawing Sheets

Related U.S. Application Data

(60) Provisional application No. 61/644,119, filed on May 8, 2012.

(51) Int. Cl.

| | |
|---|---|
| ***F21L 4/00*** | (2006.01) |
| ***F21V 1/00*** | (2006.01) |
| ***F21V 5/00*** | (2015.01) |
| ***F21V 14/06*** | (2006.01) |
| ***F21V 23/00*** | (2015.01) |
| ***F21V 23/04*** | (2006.01) |

(52) U.S. Cl.
CPC ..... *F21V 14/065* (2013.01); *F21V 21/084* (2013.01); *F21V 23/003* (2013.01); *F21V 23/0414* (2013.01)

(56) References Cited

U.S. PATENT DOCUMENTS

| | | | |
|---|---|---|---|
| 1,813,755 | A | 7/1931 | Neuner |
| 2,592,208 | A | 4/1952 | Stamper |
| 2,848,598 | A | 8/1958 | Amlee |
| 3,705,983 | A | 12/1972 | Yamada |
| 3,811,157 | A | 5/1974 | Schenk |
| 3,836,763 | A | 9/1974 | Hoffman et al. |
| 4,007,516 | A | 2/1977 | Couldes |
| 4,286,311 | A | 8/1981 | Maglica |
| 4,348,715 | A | 9/1982 | Christensen et al. |
| D324,430 | S | 3/1992 | Sharrah et al. |
| 5,103,384 | A | 4/1992 | Drohan |
| 5,605,394 | A | 2/1997 | Chen |
| D380,858 | S | 7/1997 | Sharrah et al. |
| D381,812 | S | 8/1997 | Sharrah et al. |
| 6,000,813 | A | 12/1999 | Krietzman |
| D435,922 | S | 1/2001 | Shing |
| D445,931 | S | 7/2001 | Shiu |
| D447,587 | S | 9/2001 | Poon |
| 6,474,837 | B1 | 11/2002 | Belliveau |
| D477,680 | S | 7/2003 | Petzl |
| D482,472 | S | 11/2003 | Shiu |
| D482,473 | S | 11/2003 | Shiu |
| D482,811 | S | 11/2003 | Petzl |
| D485,384 | S | 1/2004 | Poon |
| D508,140 | S | 8/2005 | Sharrah |
| D529,213 | S | 9/2006 | Shiu |
| D532,537 | S | 11/2006 | Shiu |
| D532,538 | S | 11/2006 | Yuen |
| 7,192,165 | B2 | 3/2007 | Petzl et al. |
| 7,226,190 | B2 | 6/2007 | Petzl et al. |
| D557,842 | S | 12/2007 | Lee |
| RE40,015 | E | 1/2008 | Belliveau |
| D560,008 | S | 1/2008 | Poon |
| D560,009 | S | 1/2008 | Spartano et al. |
| D568,509 | S | 5/2008 | Shiu |
| 7,410,272 | B2 | 8/2008 | Halasz |
| 7,651,239 | B2 | 1/2010 | Spartano et al. |
| 7,690,815 | B2 | 4/2010 | Dallas et al. |
| 7,738,229 | B2 | 6/2010 | Bayat et al. |
| 8,148,912 | B2 | 4/2012 | Kim |
| 8,807,781 | B2 | 8/2014 | Weber |
| 9,285,105 | B2 | 3/2016 | Sharrah et al. |
| 2003/0043576 | A1 | 3/2003 | Maglica et al. |
| 2003/0151914 | A1 | 8/2003 | Kish et al. |
| 2004/0190286 | A1 | 9/2004 | Chapman |
| 2005/0237737 | A1 | 10/2005 | Kim |
| 2008/0068832 | A1 | 3/2008 | Spartano et al. |
| 2008/0273324 | A1 | 11/2008 | Becker et al. |
| 2010/0033963 | A1 | 2/2010 | Maglica |
| 2010/0073783 | A1 | 3/2010 | Sun |
| 2010/0148697 | A1 | 6/2010 | Bayat et al. |
| 2011/0222273 | A1 | 9/2011 | Maglica |
| 2011/0235313 | A1 | 9/2011 | Canella |
| 2012/0182724 | A1* | 7/2012 | Janice ..... F21L 4/027 362/158 |

FOREIGN PATENT DOCUMENTS

| | | |
|---|---|---|
| EP | 0111818 | 6/1984 |
| EP | 1588094 | 3/2008 |
| FR | 2745627 | 9/1997 |
| FR | 2850448 | 1/2006 |
| GB | 2264164 | 8/1993 |
| WO | 01/57431 | 8/2001 |
| WO | 2004/070268 | 8/2004 |

OTHER PUBLICATIONS

Adaro Tecnologia, SA, "Adalit L2000-L/LB Safety Rechargeable Torch User Instructions", Publicacion No. EP-DA-8/3, Emision: Enero 08. Rev.3, date: Jul. 24, 2006, 16 pages.

Streamlight, "Argo Luxeon Headlamp," http://www.streamlight.com/argo_info.htm, Printed Oct. 18, 2004, 2 Pages.

Streamlight, "Argo Luxeon Headlamp Specifications," http://www.streamlight.com/argo_spec.htm, Printed Oct. 18, 2004, 1 Page.

Streamlight, "Wow Parts & Accessories," http://www.streamlight.com/wow_accessories.htm, Printed Oct. 18, 2004, 1 Page.

Streamlight, "Wow Specifications," http://www.streamlight.com/wow_specifications.htm, Printed Oct. 18, 2004, 1 Page.

Streamlight, "TopSpot II Specifications," http://www.streamlight.com/topspot_2_specifications.htm, Printed Oct. 18, 2004, 1 Page.

Streamlight, "TopSpot II Parts & Accessories," http://www.streamlight.com/topspot_2_accessories.htm, Printed Oct. 18, 2004, 1 Page.

Streamlight, "Septor Information," http://www.streamlight.com/septor_info.htm, Printed Oct. 21, 2004, 2 Pages.

Streamlight, "Septor Specifications," http://www.streamlight.com/septor_spec.htm, Printed Oct. 21, 2004, 1 Page.

Streamlight, "Trident Information," http://www.streamlight.com/trident_info.htm, Printed Oct. 21, 2004, 2 Pages.

Streamlight, "Trident Specifications," http://www.streamlight.com/trident_spec.htm, Printed Oct. 21, 2004, 1 Page.

Streamlight, "New Trident/New Septor/New ClipMate," Led Technology Meets Streamlight Quality, Sep. 2002, Pamphlet. #990633.

Streamlight, "New ARGO Luxeon LED Headlamp," Feb. 2004, Pamphlet.: #990661.

Lab Safety Supply, "BRIGHT STAR® WorkSafe® Razor Zone Zero Flashlight", © 2011 GHC Specialty Brands, LLC, www.labsafety.com/bright-star-worksafe-razor-zone-zero-flashlight_24535811, 2 pages.

Global Stores Group Industrial & Safety Division, "Bright Star Razor LED Flashlights", © 2006, www.allsafetysupplies.com/bright-star-razor-LED-flashlights_p_14674, 2 pages.

Bright Star, "Product Data Sheet: Razor 3AA-cell LED Flashlight", date prior to May 5, 2011, 1pg.

Streamlight, Inc., "Product Fact Sheet—3C Luxeon Division1/Division 2 ProPolymer® Alkaline Battery-Powered Flashlight", Document 158, Rev. Feb. 5, 2007, 1 page.

Streamlight, Inc., "ProPolymer® 2AA/4AA/3C Operating Instructions", © 2008, 4 pages.

Streamlight, Inc., "ProPolymer® 3C Lux Div 1", © 2011, 4 page.

International Searching Authority, "PCT Search Report and Written Opinion", International Application No. PCT/US12/36287, Aug. 7, 2012, 10 pages.

Pelican Products US, "Photos of MityLite 1965 LED", photos taken Apr. 12, 2012, 2 pages.

Pelican Products US, "Pelican MityLite 1965 LED", printed Apr. 12, 2012, 2 pages, www.pelicanproducts.us/p.pelican/mitylite.1965.led.flashlight.html.

Pelican Products US, "Pelican MityLite 1965 LED Instructions (CAT #1965)", © 2011, 2 pages.

Bayco Products, Ltd, "Photos of NightStick NSP-5422 Light", photos taken Apr. 12, 2012, 2 pgs.

Bayco Products, Ltd, "XPP-5420 Series—80 Lumen Intrinsically Safe Flashlight That's Waterproof", printed Apr. 12, 2012, 4 pages.

Bayco Products, Ltd, "NightStick Catalog (CAT-NS-11C)", date prior to Apr. 27, 2012, pages include: cover, 1, 2, 8-11, 19, 23 and back.

(56) References Cited

OTHER PUBLICATIONS

Bayco Products, Ltd, "NightStick Pro Flyer (FLY-5422-10)",date prior to Apr. 27, 2012, 2 pages.
U.S. Dept. of Labor, MSHA, "Criteria for the Evaluation and Test of Intrinsically Safe Apparatus and Associated Apparatus (ACRI2001)", Nov. 4, 2008 (Third Edition), 11 pages.
Underwriters Laboratories, Inc., "Electrical Apparatus for Explosive Gas Atmospheres—Part 0: General Requirements (UL60079-0)", Fourth Edition, Aug. 15, 2005, 8 pages.
Underwriters Laboratories, Inc., "Explosive Atmospheres—Part 11: Equipment Protection by Intrinsic Safety "I" (UL60079-11)", Fifth Edition, Sep. 30, 2009, 8 pages.
Underwriters Laboratories, Inc., "Intrinsically Safe Apparatus and Associated Apparatus for Use in Class I, II, and III, Division 1, Hazardous (Classified) Locations (UL 913)", Seventh Edition, Jul. 31, 2006, 4 pages.
International Standard, "Explosive Atmospheres—Part 0: Equipment—General Requirements (IEC 60079-0)", Edition 5.0, Oct. 2007, 10 pages.
International Standard, "Electrical Apparatus for Use in the Presence of Combustible Dust—Part 0: General Requirements (IEC 61241-0)", First Edition, Jul. 2004, 7 pages.
International Standard, Explosive Atmospheres—Part 11: Equipment Protection by Intrinsic Safety "i" (IEC60079-11), Edition 6.0, Jun. 2011, 8 pages.
Sharrah, Jonathan R., et al., "Portable Light", U.S. Appl. No. 14/260,369, filed Apr. 24, 2014, 50 pages.
U.S. Patent and Trademark Office, "Office Action—U.S. Appl. No. 13/488,563", May 8, 2013, 11 pages.

* cited by examiner

PORTABLE LIGHT HAVING A HOUSING INCLUDING A LOCK

This application is a division of U.S. patent application Ser. No. 13/668,532 filed on Nov. 5, 2012, and entitled "HEAD LIGHT HAVING A ROTATABLE FACE CAP WITH PLURAL LENSES" which claims the benefit of U.S. Provisional Patent Application No. 61/644,119 entitled "HEAD LIGHT HAVING A ROTATABLE FACE CAP" filed May 8, 2012, each of which is hereby incorporated herein by reference in its entirety.

The present invention relates to a light and, in particular, to a light having a housing including a locking arrangement.

Additionally and/or alternatively, the light may have a housing pivotable on a mount and may include a detent arrangement therefor.

Conventional portable devices including portable lights, e.g., flashlights and headlights, typically may be disassembled relatively easily as is convenient for, e.g., replacing a discharged battery. Commonly, either a light head portion of the light or a tail cap or cover portion thereon or both can be unscrewed or otherwise removed from the light to gain access to the battery inside the body of the light. Certain conventional portable lights are also sealed, e.g., by gaskets and/or O-rings, so as to resist the entry of undesired substances, e.g., moisture, dirt and debris, and may be sealed to resist entry of water (if intended or likely to be underwater) and/or a hazardous fluid (if intended or likely to be used in a hazardous environment).

Hazardous environments may include, e.g., mines, refineries, repair and maintenance operations, fueling stations, storage sites, industrial and government locations where ignitable concentrations of flammable gases, vapors and/or liquids can exist, usually as a normal or expected occurrence. Lights utilized in such environments, as well as in non-hazardous environments, may be mountable to the body or apparel of a user so that both of the user's hands are freed from holding the light and so are available to perform tasks.

Head lights provide such hands-free operation by being attached to a strap or band that is placed on a user's head, either directly or on a hat or helmet worn on the head. Typically, the light body is pivotably mounted to a base to which the strap or band attaches. Thus, the elevation angle of the light beam from the light may be adjusted by pivoting the light body without removing the light from the user's head, and the azimuth angle follows the movement of the user's head.

Conventional head lights had a simple control, e.g., a button to provide ON and OFF control of the light source. As portable lights have become more advanced, additional operating modes for the light source have come to be desired, but more numerous and complex operating modes tend to lead to more complex controls which can be difficult for a user to operate without looking at the control. Having to look at the control is particularly undesirable for a head light because it would require the head light to be removed from the user's head so that the light and its control could be observed while being utilized.

In addition, these different user selectable modes may include providing illumination having different beam characteristics, e.g., a generally narrower or spot light beam or a generally broader or flood light beam. Often a conventional light beam changing feature will involve one control for controlling the light source and another control for selecting the desired beam characteristic.

Portable devices and lights intended for use in a hazardous environment often are or are required to be certified as being "safe" for use in the intended hazardous environment. Agencies and organizations such as Underwriter's Laboratory ("UL" in the United States), ATEX (Europe) and the Mine Safety and Health Administration (MSHA, part of the Department of Labor in the United States), as well as other organizations and agencies, serve as official or unofficial standard setting and certifying agencies regarding safety. One prior art approach regarding safety is to try to make a device or light that is "intrinsically safe."

An "intrinsically safe" device or light may have an electrical circuit that is intended to limit the amount of energy that can be produced so that it cannot produce a spark or thermal heat sufficient to cause fire or ignition of a flammable or combustible mixture in air at the lowest ignitable concentration. A portable device or light cannot be claimed to be "intrinsically safe" unless it has been appropriately certified for a particular hazardous condition by an appropriate certifying agency. However, internal energy limited circuitry does not prevent a user from disassembling a device or light while in a hazardous environment.

At present, one or more certifying agencies require that a device, e.g. a flashlight, cannot be certified as "intrinsically safe" or receive a certain safety rating unless it cannot be disassembled in a hazardous location, e.g. the head and/or battery compartment cover cannot be removed, without the use of a tool or a special fastener.

Applicant believes there is a need for a portable device, e.g., a light, that has a simple control that can provide different operating conditions for the light. Additionally and/or alternatively, it would also be desirable for the device, e.g., a light, to include an optional locking arrangement that prevents disassembly without the use of a tool, and in which parts of the locking arrangement are captive against misplacement or loss. Additionally and/or alternatively, it would further be desirable to have a device, e.g., a light, that is pivotable on a mount and including a detent arrangement.

Accordingly, a portable light may comprise: a light housing; a light source in the light housing; a face cap rotatably mounted to the light housing and having one or more lenses positionable in front of the light source; a light source control circuit interior the light housing and having a switch actuator for selectively energizing the light source; and an actuator member of the face cap for actuating the switch actuator.

According to another aspect, a portable light may comprise: a light housing including a front housing portion and a rear housing portion fastened together and not separable without using a tool; a light source in the light housing; a face cap rotatable on the light housing and having one or more lenses for being positioned in front of the electrical light source, the face cap not being removable from the light housing without using a tool; a light source control circuit interior the light housing having a switch actuator for selectively energizing the light source; and an actuator member of the face cap, wherein rotating the face cap moves the actuator member into a position to actuate the switch actuator.

A portable light may comprise: a light housing including a front housing portion and a rear housing portion fastened together; an electrical light source in the light housing; a face cap having at least one lens positioned in front of the electrical light source; a light source control circuit having a switch actuator for selectively controlling the energization of the light source; a curved light base including a cantilevered flexible member extending generally tangential to the curve thereof; a pivotable mount pivotably mounting the light housing to the curved light base; and a detent for retaining the light housing and the curved light base in a pivot position.

In another aspect, a portable light may comprise: a light housing having housing parts for enclosing a source of electrical power and supporting an electrical light source, a slide latch slidable on the light housing parts between latched and unlatched positions; a projection proximate the slide latch when the housing parts are adjacent; wherein when the slide latch is moved to the latched position, separation of the housing parts is prevented, and wherein when the slide latch is moved to the unlatched position, the housing parts can be separated. A tool may be needed to open the housing.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so are not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGURES of the Drawing which include.

Figure 1:
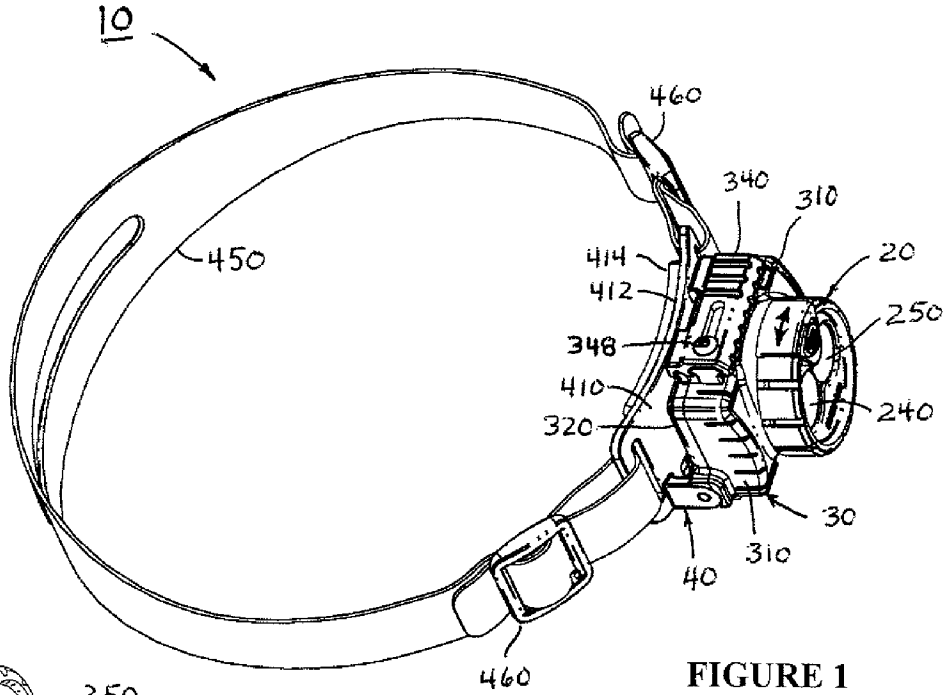
FIG. 1 is a perspective view of an example embodiment of a light having a rotatable face cap with plural lenses.

In the Drawing, where an element or feature is shown in more than one drawing figure, the same alphanumeric designation may be used to designate such element or feature in each figure, and where a closely related or modified element is shown in a figure, the same alphanumerical designation primed or the like may be used to designate the modified element or feature. Similarly, similar elements or features may be designated by like alphanumeric designations in different figures of the Drawing and with similar nomenclature in the specification. According to common practice, the various features of the drawing are not to scale, and the dimensions of the various features may be arbitrarily expanded or reduced for clarity, and any value stated in any Figure is given by way of example only.

DESCRIPTION OF THE PREFERRED EMBODIMENT(S)

The example light described herein is illustrated as a head lamp or head light, e.g., a light that may be attached to a user's head, hat helmet or other head gear, or to a uniform or other clothing, or to another object, however, the example light and its features described herein may be also be embodied in lights of other configurations, e.g., hand held lights, portable lights, flashlights, lanterns, and the like.

Figure 1A:
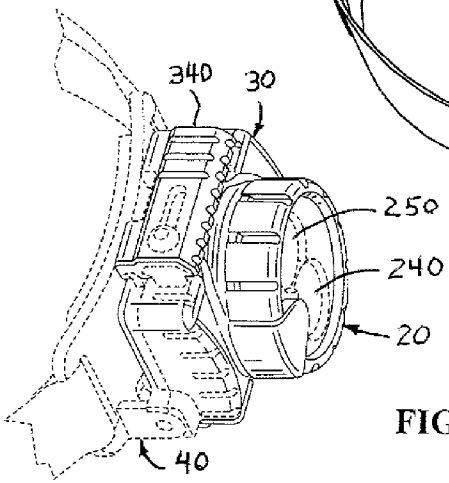
FIG. 1A is a perspective view of the example light with the rotatable face cap rotated to a different position.
Figure 2C:
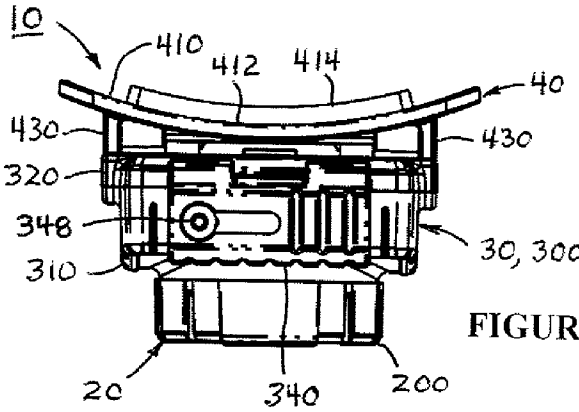
FIG. 2 includes FIGS. 2A, 2B and 2C which are front, side and top views, respectively, of the example embodiment of a light having a rotatable face cap with plural lenses.
Figure 2A:
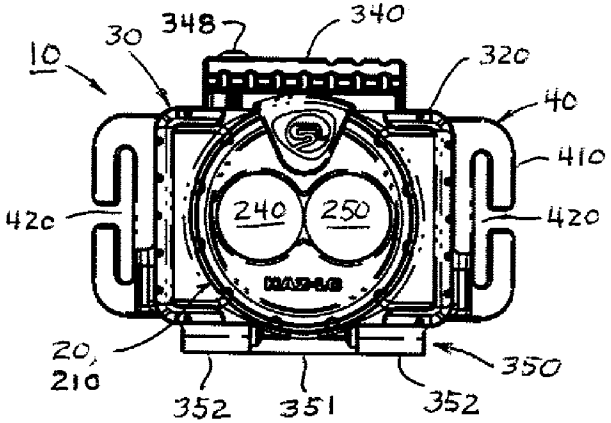
Figure 2B:
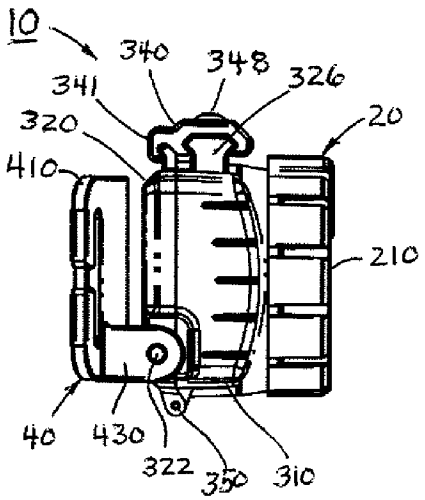

FIG. 1 is a perspective view of an example embodiment of a light 10, FIG. 1A is a perspective view of the example light 10 with the rotatable face cap assembly 20 rotated to a different position, and FIG. 2 includes FIGS. 2A, 2B and 2C which are front, side and top views, respectively, of the example embodiment of a light 10 having a rotatable face cap 20 with plural lenses 240, 250. Light 10 includes a rotatable face cap assembly 20 that is rotatably mounted to housing assembly 30 and is rotatable thereon for selectively energizing the light source of light 10 and/or for selecting the lens 240, 250 that is positioned in the beam of light emitted by a light source therein and/or the beams of light produced by plural light sources therein. Typically, but optionally, face cap 20 of light 10 may have plural lenses 240, 250, e.g., lenses having different optical properties.

Rotatable face cap assembly 20 includes a housing 210 having a circular wall 220 and a planar end or face 230 thereby to define a hollow cylinder that is closed at one end and open at the other end. Planar face 230 provides one or more lenses 240, 250 that may have different optical properties, e.g., different focuses, different focal lengths, different transmissive properties, different color properties and the like.

Housing assembly 30 includes a front housing 310 and a rear housing cover or plate 320 that together define a closed housing 300 to which face cap assembly 20 mounts rotatably. Rear cover 320 has a pair of opposing coaxial posts 322 that pivotably engage openings in mounting 40 to provide a pivotable connection thereto. Where the operation of light 10 is controlled by rotation of face cap 20, housing 300 may be sealed and need not have an opening for a switch or for an actuator for actuating an electrical switch.

Where light 10 is to be configured as a head light, housing 30 is preferably pivotably connected to a mounting 40 which includes a light base 410 which typically is curved for providing a convex surface for being disposed adjacent a user in use, e.g., adjacent a head, helmet or other part. Typically, base 410 has one or more slots 420 or other openings for receiving a head band or strap 450 by which light 10 may be attached (e.g., strapped, banded or tied) to a user or object. Band 450 may be, e.g., a woven material, and may have a buckle or clip 460 for adjusting its length to fit a particular user or object, and/or may be, e.g., elastic so as to stretch to fit a particular user and/or object, and may optionally have a buckle or clip 460. Optionally, base 410 may have a pad or cushion 414 on its concave surface 412 or may have an adhesive or hook-and-loop fastener or another fastener 414 thereon for attaching light 10 to a user or object.

Light base 410 typically has a pair of opposing projecting members 430 extending therefrom which have respective openings 432 for receiving respective opposing projecting posts 322 of housing 300, e.g., of rear housing 320 thereof, therein for providing a pivotable connection of light housing 30 and mounting 40. The pivotable connection 322, 430, 432 permits housing 30 to be placed into (pivoted to) a desired orientation relative to mounting 40 and light base 410 thereof, so that light 10 may be oriented to direct light produced thereby in a desired direction.

The pivotable connection between housing assembly 30 and mounting 40 may include a detent or ratchet or other friction providing element for tending to maintain the relative positions between housing 30 and mounting 40 into which a user may pivot housing 30 relative to mounting 40. One example thereof is where one or both of mounting base 410 and or housing assembly 30 include a number of teeth or projections that engage and disengage under pressure so as to provide a detent that will retain housing assembly 30 in a desired pivotal position relative to mounting 40, and therefore relative to a user or object to which light 10 may be mounted. An example detent arrangement 800 is described herein below.

Another example thereof is where adjacent areas of housing 300 and of mounting base 410 each include a number of corresponding teeth or other projections that engage and disengage each other under pressure so as to provide a detent that will retain housing assembly 30 in a desired pivotal position relative to mounting 40, and therefore relative to a user or object to which light 10 may be mounted. Alternatively, surfaces of housing assembly 30 and mounting base 40 that are adjacent may be made to abut and may have respective surfaces that create friction or that may have a friction-providing element, e.g., a rubber washer or O-ring, placed between housing assembly 30 and mounting 40 to provide friction.

In the example light 10 of FIG. 1, e.g., rear housing (cover) 320 is hinged or otherwise pivotably attached 350 along one edge to the corresponding edge of front housing 310 and the opposing edges thereof are pressed and retained close together by a slide latch 340 that slidably engages and disengages respective raised ridges 326, 328 on housing parts 310, 320 and is held captive by a fastener 348 disposed in a hole of front housing 310. Preferably, and optionally, an insert may be pressed or molded into front housing 310 to receive fastener 348 therein.

Preferably, fastener 348 is a threaded fastener 348, e.g., a screw or bolt, that can be rotated to advance (be driven in) to housing 310 to retain (lock) slide 340 in a position that locks housing parts 310, 320 together and that can be rotated in an opposite direction to release slide 340 to be movable along the edge of body assembly 30 to release housing parts 310, 320 for being separated, e.g., for removing and replacing batteries therein. Fastener 348 has an interface 348T at one end thereof, e.g., a grip head or recess in a head, for being grasped and/or receiving an object or tool for rotating fastener 348. The threaded insert, if any, in housing 300 typically is metal and is correspondingly threaded to receive threaded fastener 348. Where light 10 is intended to be usable in hazardous environments, fastener 348 is only movable to release slide 340 by a tool that engages its tool interface 348T, and preferably by a tool that is less available than a common simple screwdriver, e.g., a hexagonal or Allen wrench, or a spined tool, e.g., a TORX® tool, or the like.

Figure 3:
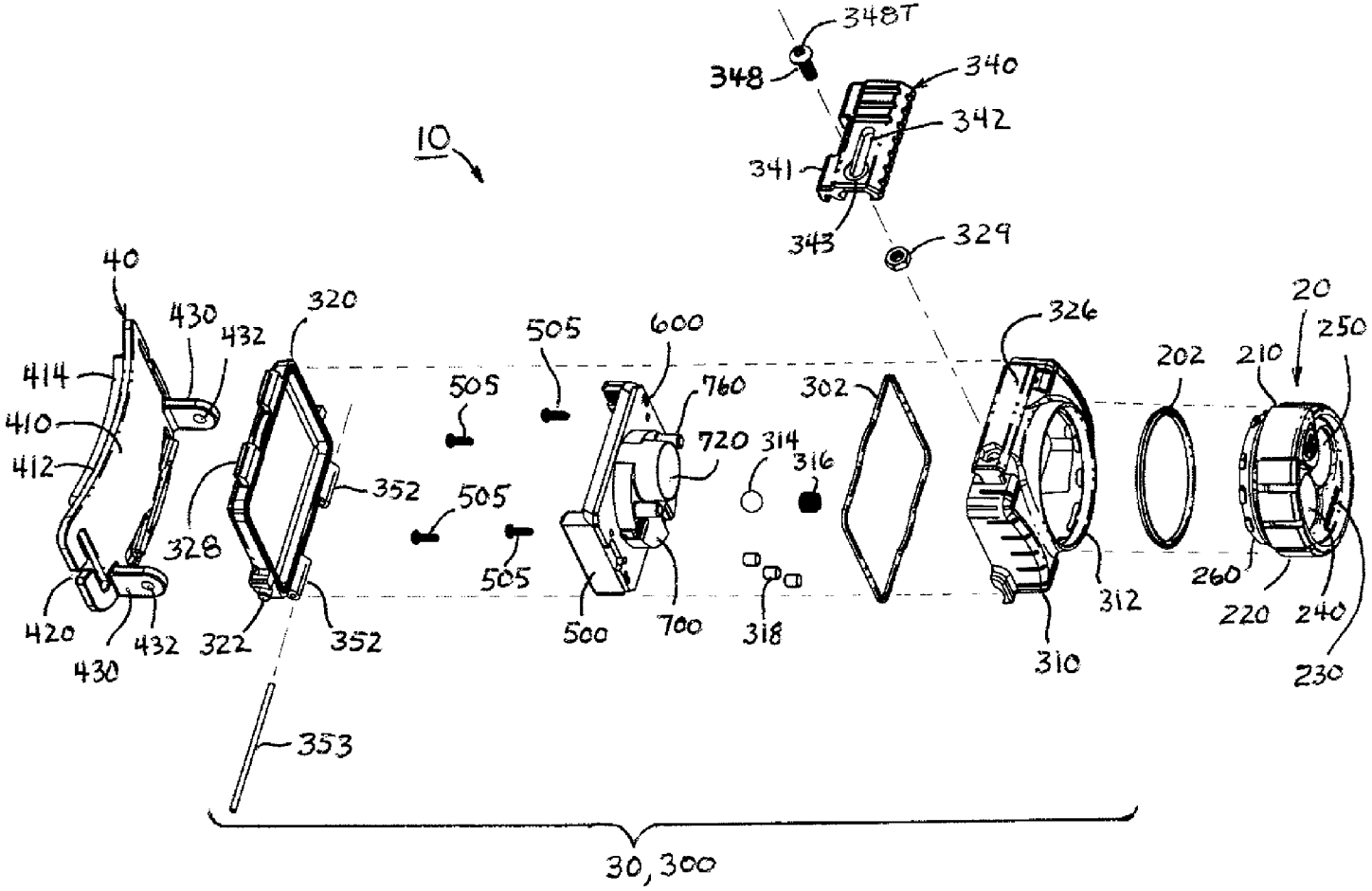
FIG. 3 is an exploded view of an example embodiment of the light of FIGS. 1 and/or 2.
Figure 4A:
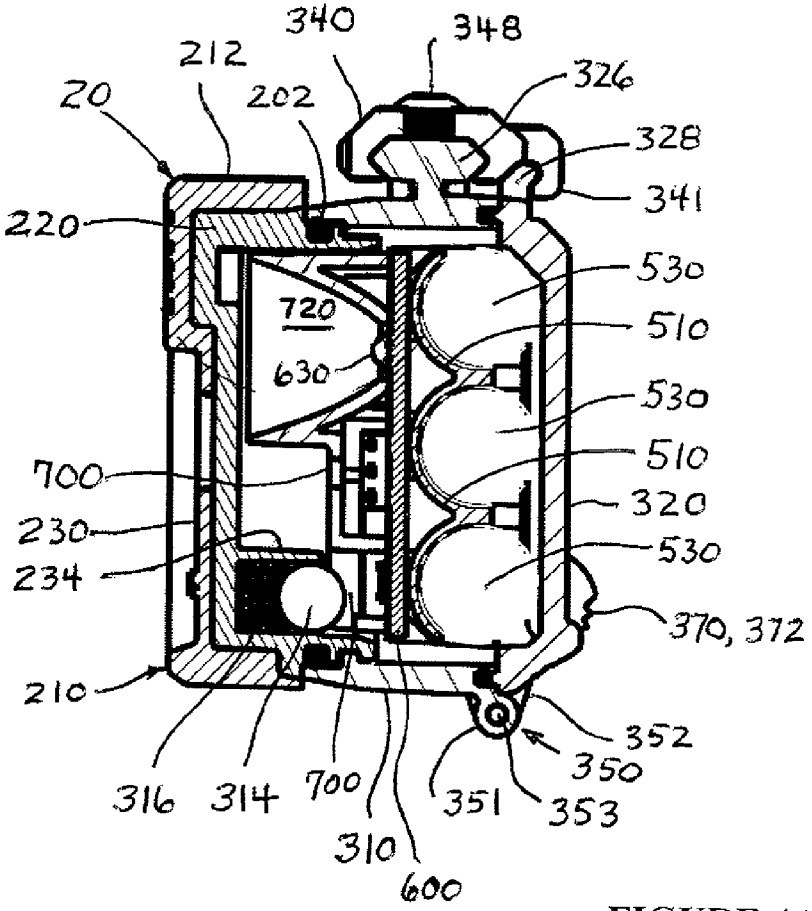
FIG. 4 includes FIGS. 4A, 4B and 4C which are a vertical (from the side) cross-sectional view, a transverse (looking upward) cross-sectional view, and a transverse cross-sectional view (in a plane through a detent), respectively, and FIGS. 4D and 4E which are vertical (in planes removing the front) cross-sectional views at two different planes, respectively, of the example light of FIGS. 1 and/or 2.

In one embodiment of light 10, slide 340 is slidably retained on a "T-shaped" raised ridge 326 of front housing part 310, as illustrated in FIGS. 3 and 4A. The threaded shaft of preferred fastener 348 is disposed through a slot 342 of slide 340 to retain slide 340 on housing 310. Slot 342 of slide 340 preferably has a circular recess 343 at the end of slot 342 over which the head of fastener 348 is disposed when slide 340 is moved to the locked position, e.g., the position at which housing parts 310, 320 are secured together, so that rotating fastener 348 to advance the head thereof into the circular recess of slot 342 to engage slide 340 creates an interference that prevents slide 340 from being moved out of the locked position unless fastener 348 is disengaged using a tool.

Slide latch 340 is movable along T-shaped ridge 326 of front housing 310 in one direction to the latched position and in the opposite direction to the unlatched position. Slide latch 340 has one or more one or more downwardly extending flanges 341 that engage one or more upwardly extending projections 328 of rear housing cover 320 when slide latch is moved (slid) along T-shaped ridge 326 to the latched position, thereby securing front and rear housing parts 310, 320 in the closed position. The one or more flanges 341 disengage the one or more projections 328 when slide latch 340 is moved (slid along rail 326) to the unlatched position.

Along the edge of housing opposite slide latch 340 is a hinge 350 for allowing rear housing cover 320 to pivot relative to front housing cover 310 when slide latch 340 is not engaged, e.g., to allow for placement or replacement of one or more batteries interior to housing 300. Hinge 350 may have, e.g., one or more clevis members 352 on rear housing cover 320 and one or more clevis members 351 on front housing 310, with a hinge pin or axle 353 passing through clevis members 351, 352.

Figure 4B:
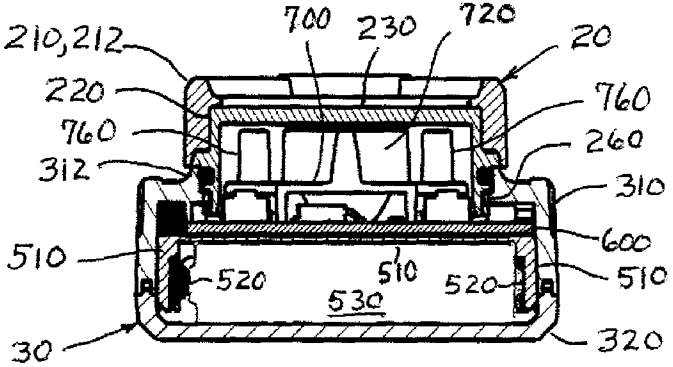
Figure 4C:
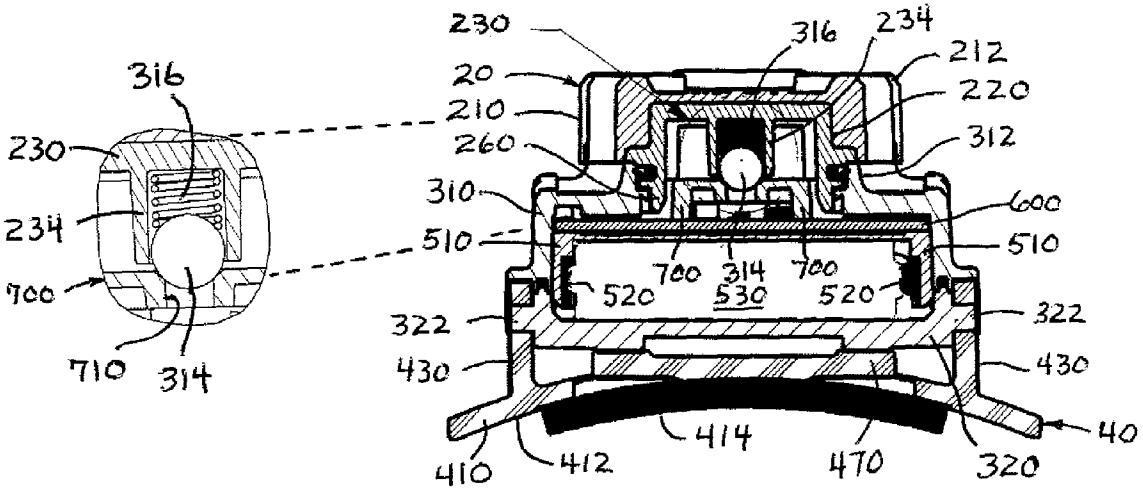
Figure 4D:
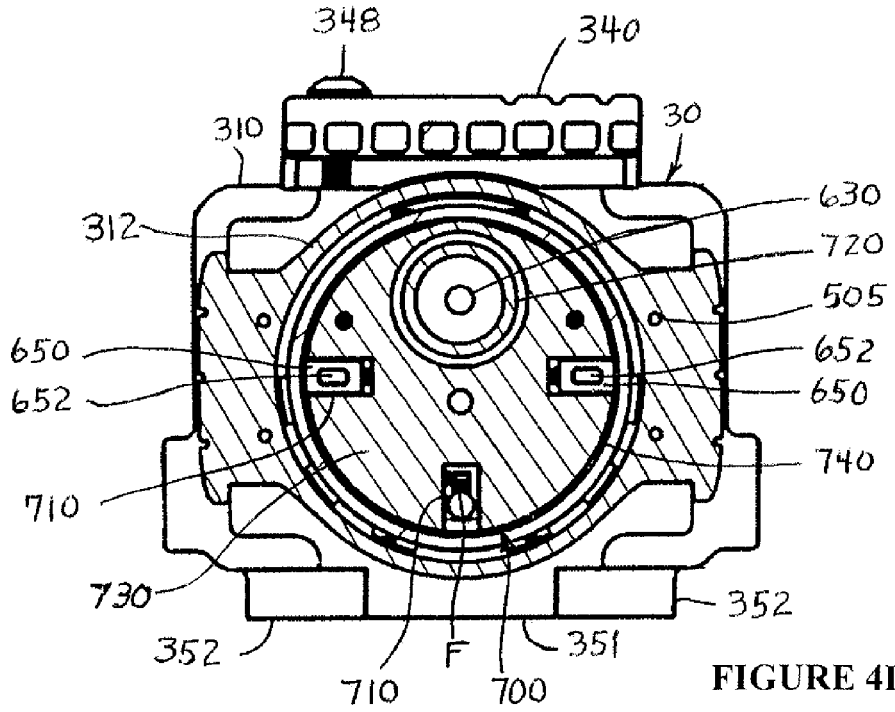
Figure 4E:
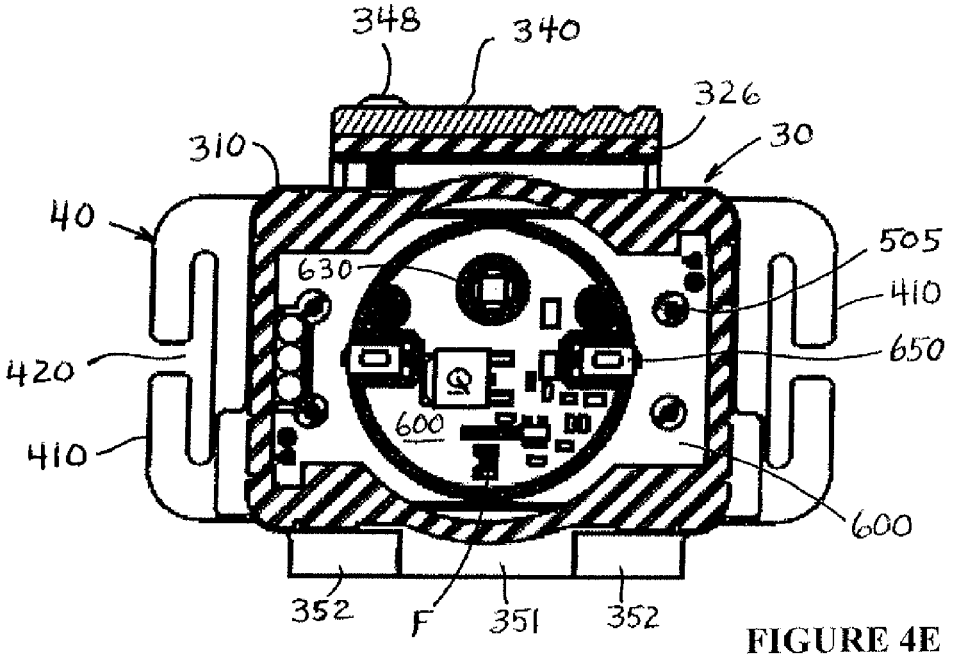

FIG. 3 is an exploded view of an example embodiment of the light 10 of FIGS. 1 and/or 2, and FIG. 4 includes FIGS. 4A, 4B and 4C which are a vertical (from the side) cross-sectional view, a transverse (looking upward) cross-sectional view, and a transverse cross-sectional view (in a plane through a detent), respectively, and FIGS. 4D and 4E which are vertical (in planes removing the front) cross-sectional views at two different planes, respectively, of the example light 10 of FIGS. 1 and/or 2. Housing 30 of light 10 includes front and rear housing parts 310, 320 that fit together to enclose a battery carrier assembly 500 therein. A gasket 302, e.g., of rubber or plastic, may be provided between housing parts 310, 320 to provide a seal therebetween for resisting the entry of dirt, moisture and other undesirable material into housing 300. Front and rear housing parts 310, 320 may be secured together by a slide arrangement 340 as described or by fasteners.

Face cap assembly 20 is rotatably mounted to a mounting ring 312, e.g., a circular cylindrical extension from front housing 310, and may be retained thereon by one or more tabs on ring 260 thereof that snap into place when face cap 20 is mounted to mounting ring 312 of front housing 310 so as to retain face cap 20 on housing 30. A seal 202, e.g., a gasket or O-ring 202, may be provided to keep unwanted dirt, moisture and other undesired material from passing between face cap 20 and housing 30.

Face cap assembly 20 typically includes a housing 210 having a generally cylindrical wall 220 extending from a generally planar face 230. The cylindrical wall 220 includes a cylindrical ring 260 that extends to engage mounting ring 312 extending from front housing 310. Planar face 230 typically includes at least one lens 240, 250 through which light produced by a light source associated with battery carrier 500 and electronic circuit board 600 passes. In one example embodiment, lens 240, 250 may be a clear lens 240 for allowing the beam of light produced by the light source to pass therethrough when face cap 20 is rotated to place lens 240 in front of the light source and lens 250 may be a translucent or diffusing lens 250 so as to provide more of a flood light like beam when face cap 20 is rotated to place lens 250 in front of the light source.

Contained within housing 300 are battery carrier assembly 500 which receives a source of electrical power, e.g., one or more batteries 530, electronic circuit board 600 which carries a light source and electronic control circuitry therefor, and a circular member 700. Circular member 700 may be a heat sink for controlling the heat produced by, e.g., the light source and/or other electronic components. Circular member 700 may have one or more, e.g., three, spaced apart recesses or notches 710 around the periphery thereof. Typically, these recesses or notches are spaced about 90° apart and may cooperate with ball 314 and spring 316 which biases ball 314 to provide a detent for tending to retain face cap 20 rotationally in a position to which it is rotated.

Specifically, face cap housing 210 may have a cylindrical wall 234 extending rearwardly from planar face 230 thereof to define a cylindrical recess into which a spring 316 and ball 314 may be placed so that ball 314 is biased rearwardly relative to housing 210 by spring 316, thereby to bear against circular member 700 when battery carrier 500, circuit board 600 and circular member 700 are contained within housing 300.

Face cap assembly 20 includes housing 210 which preferably is a molded assembly including a transparent and/or translucent "cup" providing cylindrical wall 220 extending from the periphery of planar face 230 and having a ring 212 at the intersection therebetween. Ring 212 may be of a resilient or other easily gripped material and/or may have a smooth exterior surface of may have one or more indentations and/or projections, e.g., a knurling or lugs, therein for assisting a user in gripping face cap 20 for rotating face cap 20 relative to housing 30.

Figure 5A:
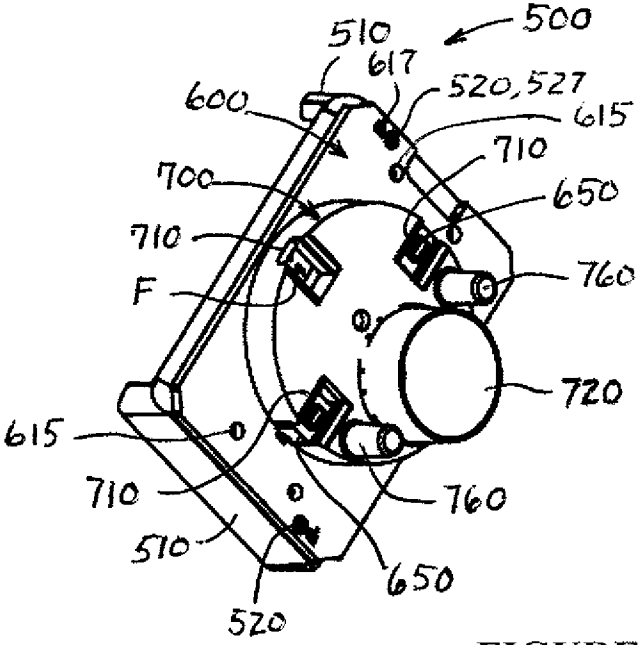
FIG. 5 includes FIG. 5A which is a perspective view and FIG. 5B which is an exploded perspective view of an example battery carrier, circuit board and circular member suitable for use in the example light of FIGS. 1 and 2.
Figure 5B:
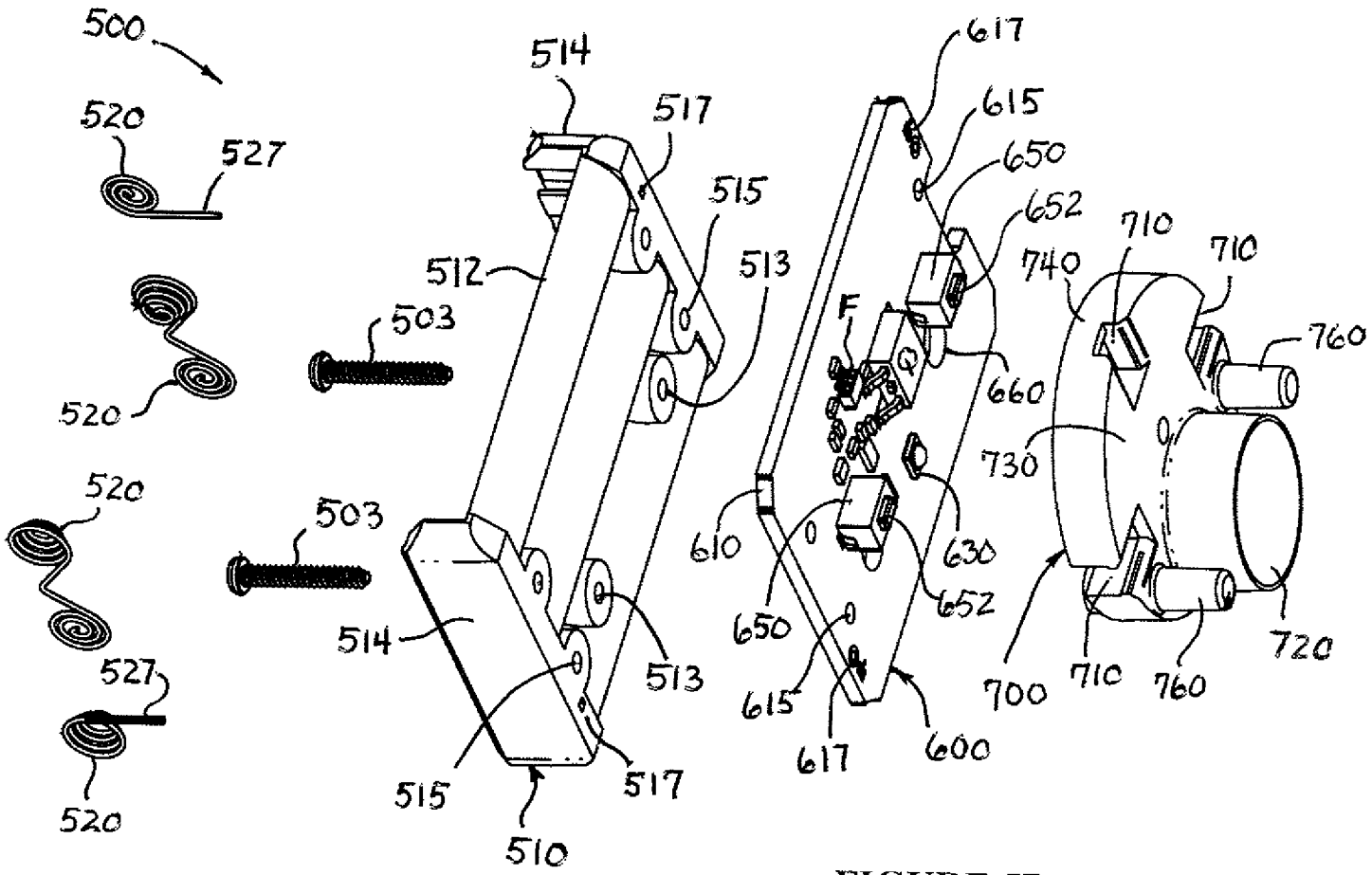
Figure 6A:
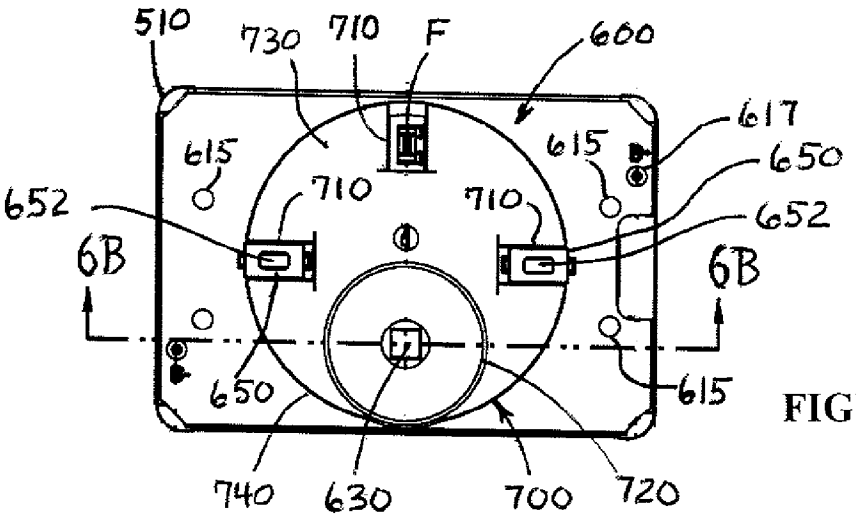
FIG. 6 includes FIG. 6A which is a plan view of the example circuit board and example circular member of FIG. 5 and FIG. 6B which is a cross-sectional view in a plane through the reflector and light source thereof.
Figure 6B:
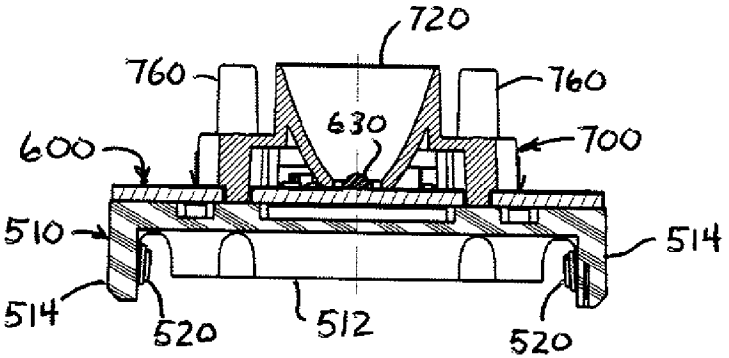

Continuing with reference to FIGS. 3 and 4A-4E, and also with regard to FIG. 5 which includes FIG. 5A which is a perspective view and FIG. 5B which is an exploded perspective view of an example battery carrier 500, circuit board 600 and circular member 700 suitable for use in the example light 10 of FIGS. 1 and 2; FIG. 6 which includes FIG. 6A which is a plan view of the example circuit board 600 and example circular member 700 of FIG. 5 and FIG. 6B which is a cross-sectional view in a plane through the reflector 720 and light source 630 thereof; and FIG. 7 which includes FIGS. 7A, 7B and 7C which are front, rear and front perspective views, respectively, of the example circular member 700 of FIG. 5.

Battery carrier 500 includes housing 510 which is shaped for receiving one or more batteries 530 of the type, shape and size intended to be placed therein for providing electrical power to light 10. Example housing 510 as illustrated is shaped to define three partly cylindrical spaces that may receive three cylindrical batteries 530 disposed side by side therein. Such batteries may be, e.g., size AA or size AAA batteries, and may be of a particular battery chemistry, e.g., carbon-zinc, alkaline, Ni-MH, Ni—Cd, lithium, and the like, as may be desired.

Within battery carrier housing 510 are plural electrical conductors 520, typically metal strips and/or metal springs 520, that define contacts for contacting the terminals of batteries 530, e.g., terminals at the opposing circular ends thereof, and that connect batteries 530 electrically in a series connection and to electronic circuit board 600 for powering light source 630 of light 10. Ends 527 of ones of springs 520 may extend through holes 517 in housing 510 to be connected, e.g., soldered, to contacts 617 of circuit board 600 for attaching and connecting circuit board 600 and battery carrier 500 together.

Light source 630 is preferably a light emitting diode (LED) 630 that is mounted to circuit board 600 or to a heat conductive member associated therewith. Circuit board 600 preferably includes thermally conductive features, such as one or more areas of copper conductor on one or both surfaces of circuit board 600 and/or filled vias therethrough, proximate LED 630 for conducting heat produced by LED 630 away from LED 630 and to a heat sink where it is dissipated. The interface between LED 630 and/or circuit board 600 may employ a thermally conductive material, e.g., a thermally conductive encapsulant or adhesive, for improving the thermal coupling thereof, which thermally conductive material may extend into the rear of circular member 700. Alternatively, circular member 700 may serve as a heat sink and so may be of a thermally conductive material and be thermally coupled to circuit board 600 and/or LED 630.

Circular member 700 is generally circular and has a cylindrical wall 740 generally perpendicular to its circular top surface 730 and, if a heat sink, may provide a thermally conductive path between circuit board 600 and that circular top surface 730. The walls 740 of circular member 700 are preferably arranged to contact circuit board 600 at locations that do not have an electronic component thereat and, if a heat sink 700 at locations that preferably have a thermally conductive feature of circuit board thereat, thereby to provide thermal conduction paths for heat produced by LED 630.

In the assembly of battery carrier 500, circular member 700 may be retained in place adjacent electronic circuit board 600 and circuit board 600 may be retained adjacent to battery carrier housing 510 by one or more fasteners 503 that extend through holes 513 of housing 510 and openings 660 of circuit board 600 and engage holes in posts 760 of circular member 700. Posts 760 extend forwardly from top surface 730 of circular member to serve as rotationally limiting stops for the rotation of face cap assembly 20 and also extend rearwardly from circular member 700 to serve as locating features 760 to positively locate circular member 700 adjacent circuit board 600. Fasteners 503 may be, e.g., drive pins or screws.

The battery carrier assembly 500 comprising battery housing 510, circuit board 600 and circular member 700 thereon may be retained in front housing 310 by one or more fasteners 505 that pass through holes 515 of battery carrier 500 and holes 615 of circuit board 600 to engage blind holes in the interior of front housing 310. Housing 510, circuit board 600 and circular member 700 may be fastened together by a fastener 503, e.g., one or more fasteners 503, passing through one or more holes 513 of housing 510 to engage holes in lower portions 760L of posts 760 of circular member 700, and the lower portions 760L of posts 760 may be disposed respectively in one or more holes 660 in circuit board 600 to positively position circular member 700 relative to circuit board 600. Fasteners 503, 505 may be, e.g., drive pins or screws or another suitable fastener.

Example circular member 700 has three recesses or openings 710 spaced around its periphery at about 90° spacing for cooperating with circuit board 600 to control operation of light 10, e.g., for selectively energizing LED 630. Another opening 720 is at the base end 723 of reflector 720 and exposes LED 630 mounted to circuit board 600 for shaping the light emitted by LED 630 to a desired beam shape. Reflector 720 typically has a reflective shaped interior, e.g., a generally parabola-like shape, having an opening at its smaller end whereat LED 630 is disposed so as to emit light into reflector 720, the light exiting at the larger end thereof, e.g., to pass through face cap 20 via one of lenses 240, 250 of face cap housing 210.

Optionally, reflector 720 may have a lens therein, e.g., a shaped plastic insert, for further shaping and/or directing the beam of light produced by LED 630. Further, lenses and/or filters 240, 250 may also provide beam shaping, e.g., either narrowing the light beam to produce a relatively concentrated spot light beam, or widening the light beam to produce a relatively dispersed flood light beam, and to this end, one or both of the surfaces of lenses 240 and/or 250 may be shaped, e.g., so as to be convex or concave, and/or one or both of the surfaces of lenses 240 and/or 250 may be smooth or may be textured, e.g., so as to diffuse light. Additionally and/or alternatively, either or both of lenses 240, 250 may be colored or otherwise have a wavelength selective characteristic to alter and/or limit the light passing therethrough.

Reflector 720, and other parts of circular member 700, may be of a thermally conductive material and may be thermally coupled to LED 630 and/or circuit board 600 proximate LED 630 for assisting in the dissipation of heat produced by operation of LED 630. Reflector 720 preferably is integral to circular member 700, e.g., as a single molded part, but may be a separate part in which case the outer surface of reflector 720 and an opening therefor in circular member 700 preferably have corresponding shapes, e.g., so as to fit together conveniently. Where circular member 700 is a heat sink, heat sink 700 and reflector 720 thereof may be thermally coupled together thereat so that reflector 720 may assist heat sink 700 in dissipating heat produced by LED 630.

The three peripheral recesses or openings 710 of circular member 700 provide recesses 710 into which ball 314 may move under the urging of spring 316 which is disposed in cylindrical recess 234 of face cap 20, thereby to provide three detent positions 710 for the rotation of face cap 20. When face cap 20 is rotated ball 314 rides along a circularly curved path on the top surface or planar face 730 of circular member 700, and when ball 314 comes into position at one of recesses 710 it is urged into that recess 710 by spring 316.

When face cap 20 is rotated so that ball 314 is in the central one of recesses 710, or is on surface 730 between recesses 710, light 10 is in the OFF condition. When face cap 20 is rotated in a first direction sufficiently that ball 314 comes into position at an end one of recesses 710, ball 314 is moved into that recess 710 by spring 316 so to press against the actuator 652 of an electrical switch 650 of circuit board 600, thereby to actuate switch 650 to put light 10 in an ON condition. Similarly, when face cap 20 is rotated in a second direction opposite the first direction so that ball 314 comes into position at the other end one of recesses 710, ball 314 is moved into that recess 710 so to press against the actuator 652 of another electrical switch 650 of circuit board 600, thereby to actuate switch 650 to put light 10 in an ON condition.

When face cap 20 is rotated in one direction to the position whereat ball 314 actuates switch 650 to illuminate light source 630, one lens 240 of face cap 20 is in a position at the larger end of reflector 720 so that light produced by LED 630 passes through lens 240. When face cap 20 is rotated in the other direction to the position whereat ball 314 actuates the other switch 650 to illuminate light source 630, the other lens 250 of face cap 20 is in a position at the larger end of reflector 720 so that light produced by LED 630 passes through lens 250.

This single action of rotating face cap 20 in either direction performs two different operations of functions of light 10, i.e. the turning ON of light 10 and the selecting of the lens 240, 250 that will affect the light produced thereby. Thus, light 10 can be arranged to operate LED 630 in different modes so that, e.g., a brighter narrower light is produced when a clear filter 240 is rotated in front of LED 630 and a diffused less bright light is produced when a diffusing filter 250 is rotated in front of LED 630, or light 10 could be arranged to operate oppositely, if desired, or could be operated to produce the same amount of light for both filters 240, 250.

While the two rotational positions of face cap 20 that place light 10 in an ON condition, i.e. with LED 630 producing light, may energize LED 630 in the same way, the two different ON positions of face cap 20 may cause LED 630 to become energized in different operating conditions. For example, LED 630 may be operated at a higher brightness (i.e. light output) in one ON position of face cap 20 and at a lower brightness at the other ON position of face cap 20, or LED 360 may include plural LEDs that produce light of different intensity and/or color, which may include visible, infrared (IR) and/or ultraviolet (UV) light, in accordance with the rotational position of face cap 20.

Circular member 700 also preferably has one or more locating features 760 on the rear side thereof for registering circular member 700 relative to circuit board 600, e.g., so that the walls 740 of circular member 700 do not interfere with electrical and/or electronic components of circuit board 600. Locating features 760 may include, e.g., cylindrical posts or keys or other rearward projections 760 that correspond in size and location to openings 660 in circuit board 600. Circular member 700 also may have a pair of holes, e.g., extending into posts 760, for receiving fasteners 503 therein to retain circular member 700 on circuit board 600.

An electrical component F of circuit board 600 may be located in the central one of notches or recesses 710 of circular member 700 (the one not containing a switch 650) where it may be thermally coupled to circuit board 600, and to circular member 700 if utilized as a heat sink. In one embodiment, component F is a fuse that protects against excessive electrical current and/or against excessive temperature. Fuse F may be encapsulated in notch 710, e.g., by thermally conductive material to improve thermal coupling to circuit board 600 and circular member 700 or by thermally insulating material to reduce such thermal coupling, or by another material having different thermal properties. Fuse F may be connected between batteries 530 and LED 630 and its control circuitry so as to prevent excessive heat generation in the event of a failure of an electronic part or component, e.g., LED 630 or a control transistor Q, thereby to make the light 10 intrinsically safe.

Preferably the corners between the walls of notches 710 and the generally circular top surface 730 of circular member 700 are beveled and/or rounded so as to ease the entry and the lifting of ball 314 therefrom. In addition, the respective surfaces of ball 314 and of circular member 700 may be treated to provide a desired contact characteristic there between. For example, ball 314 may be lubricated by a silicone or oil or grease or other lubricant so as to reduce friction with circular member 700. Alternatively, the top surface 730 of circular member 700 may be so treated or may have a friction controlling member thereon.

As can be seen in FIGS. 5B and 6A-6B, battery carrier assembly 500 housing 510 has a pair of opposing end walls 514 joined by one or more curved members 512, wherein the curved member 512 is generally one or more partial cylinders against which cylindrical battery cells 530 may be disposed. End walls 514 have recesses for receiving the different contact springs 520 therein and have holes 517 through which the ends 527 of two of contact springs 520 may pass to engage contact holes 617 of electronic circuit board 600. Housing 510 further has holes 513, 515 through which fasteners 503 and 505, respectively, pass for maintaining battery carrier 500 as an assembly and retaining it in front housing 310.

Electronic circuit board 600 includes a planar electrically insulating member 610 on which are provided electrical conductors for connecting the electronic components thereon, e.g., LED 630, switches 650, transistor Q, fuse F and other components, to define an electronic circuit for the operation of LED 630 responsive to the position of face cap assembly 20 and switches 650 of light 10. Switches 650 are mounted to circuit board insulating member 610 in positions so that they are disposed in recesses 710 of circular member 700 when member 700 is mounted to circuit board 600, whereby actuators 652 of switches 650 are positioned for being actuated by ball 614 as described. Circuit board member 600, 610 has openings therein for receiving rearward facing locating features 760 of circular member 700.

Figure 7B:
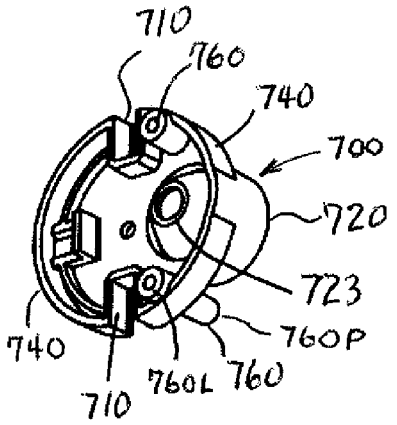
FIG. 7 includes FIGS. 7A, 7B and 7C which are front, rear and front perspective views, respectively, of the example circular member of FIG. 5.
Figure 7A:
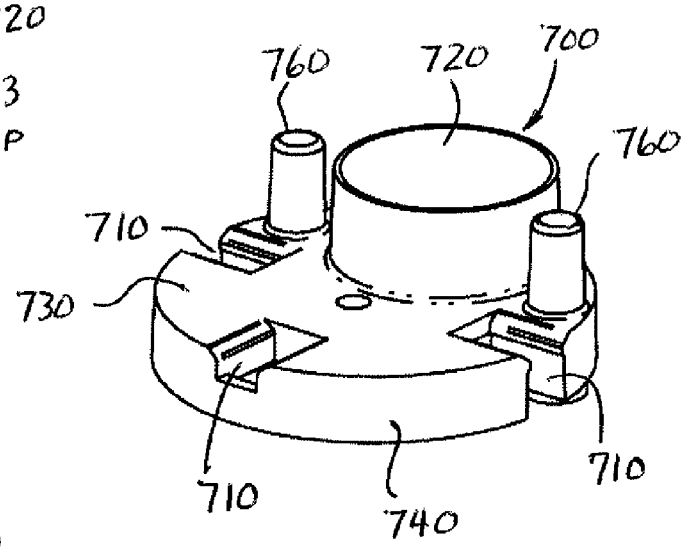
Figure 7C:
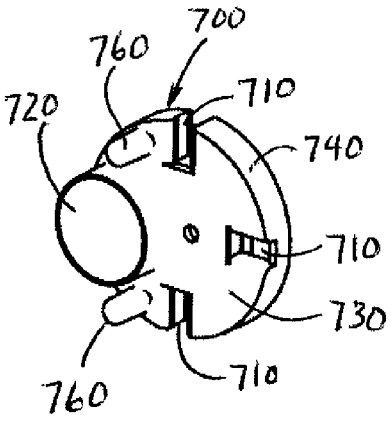

As can be seen in FIGS. 7A-7C, circular member 700 has a generally cylindrical wall 740 extending rearwardly from a generally circular top planar face 730 from which reflector 720 extends forwardly. Recesses 710, e.g., three recesses 710, are generally rectangular and are sized for receiving, e.g., switches 650 and fuse F of circuit board 600. The rearward or smaller end 723 of reflector 720 has an opening for receiving light source 630 and the light produced thereby. Each post 760 has a portion 760P that extends forwardly from planar face 730 to provide a stop or limit on the rotational range through which face cap assembly 20 may be rotated and has a portion 760L that extends rearwardly to provide one or more locating features 760 that are disposed in one or more locating openings 660 of circuit board 600 thereby to locate circular member 700 in a predetermined location on circuit board 600. The rearward portion 760L of one or more of the posts 760, locating features 760 preferably has a hole therein for receiving one or more fasteners 503.

Figure 8:
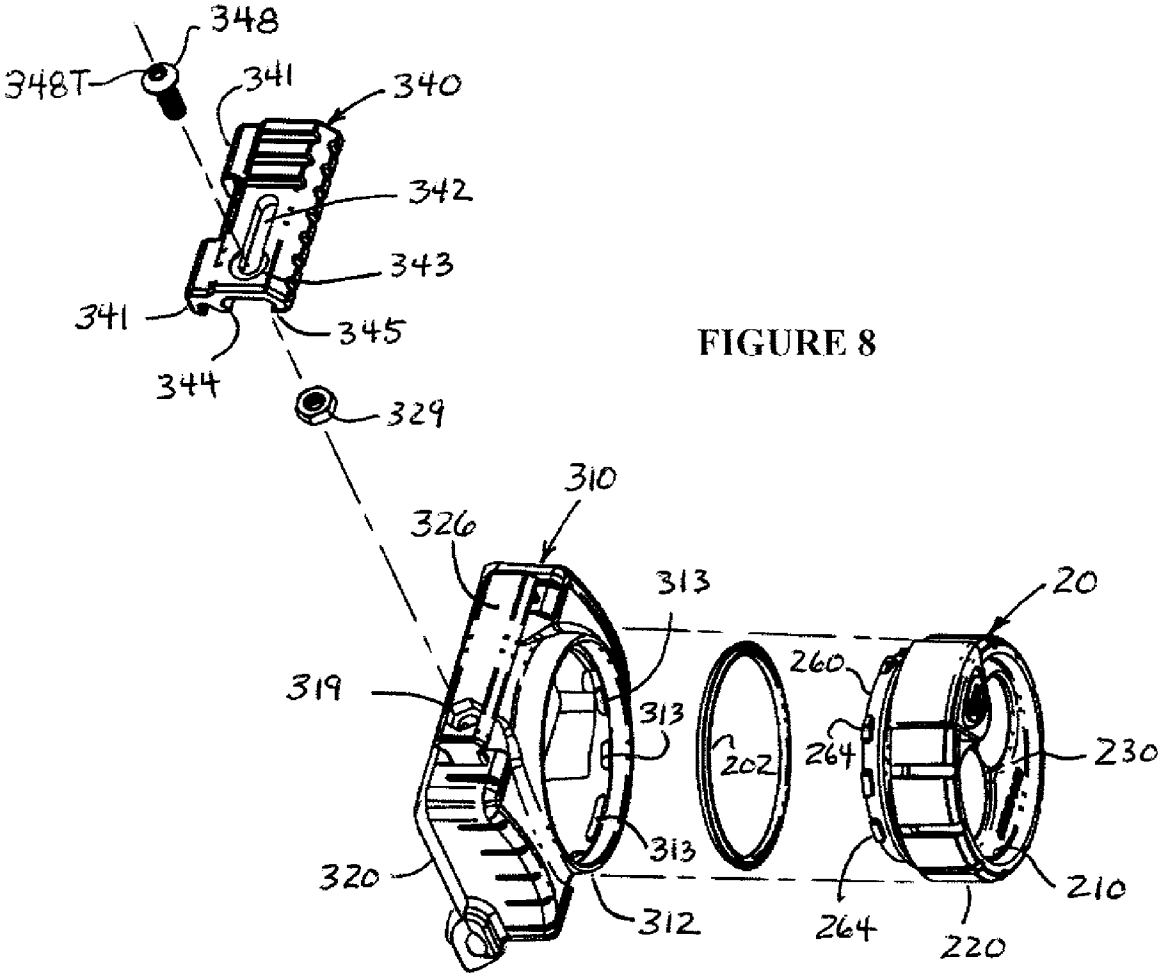
FIG. 8 is an exploded view of certain parts of the example light for illustrating the engaging arrangement between the example face cap and the example light body of the example light of FIGS. 1 and 2.

FIG. 8 is an exploded view of certain parts of the example light 10 for illustrating the engaging arrangement between the example face cap 20 and the example light body 30 of the example light 10 of FIGS. 1 and 2. As described, light 10 may be (but need not be) a sealed unit and may be configured so as not to be openable except through the use of a tool, e.g., to separate front and rear housings 310, 320 which preferably requires the use of a tool at least for removing the one or more fasteners 340, 348 that secure housing parts 310, 320, and the one or more fasteners are preferably held captive in their one or more respective holes in front housing 310. In this instance, when face cap 20 is mounted to front housing 310 it attaches thereto in a manner that prevents face cap 20 from being removed therefrom, specifically face cap 20 may only be released from the inside of front housing 310, which would require using a tool to open and to disassemble housing assembly 30.

Face cap 20 is preferably assembled to housing 300 by placing the rearward facing ring 260 of face cap 20 coaxially over circular ring 312 of front housing 310 and moving face cap 20 towards housing 300 until it becomes seated on circular ring 312, e.g., preferably with a seal 202 therebetween. To become seated on housing 310, circular ring 260 of face cap housing 210 must be inside circular ring 312 of front housing 310 and face cap 20 must be in an angular position relative to housing 310 whereat the radially extending raised projections (e.g., nubs) 264 of circular ring 260 can pass between the corresponding raised projections (e.g., nubs) 313 of circular ring 312 of front housing 310.

The raised projections 264, 313 are preferably arranged in respective complementary patterns with their respective nubs 264, 313 being non-uniformly spaced and/or sized, preferably so that in at least one unique angular orientation the nubs may pass between each other to allow face cap 20 to be seated on ring 312 of housing 310, but when face cap 20 is rotated from that at least one unique angular orientation, the respective nubs 264, 313 cannot pass between one another and so face cap 20 is held captive on housing 30. For example, one of nubs 313 of ring 312 may be longer than other ones of nubs 313 thereof and one of the gaps between adjacent nubs 264 may be correspondingly wider (longer) than the other gaps thereof so as to permit the longer nub 313 to pass through the longer gap.

Then face cap 20 may be rotated relative to housing 30 to cause projections 264 on ring 260 of face cap housing 210 to move behind the projections 313 on ring 312 of front housing 310 into positions whereat face cap 20 cannot be removed from housing 30. Because of the respective different shapes and spacings of projections 264 and 313, once face cap 20 is rotated on ring 312 of housing 300, e.g., by about 180°, it cannot be removed therefrom, and preferably, face cap 20 cannot be rotated in the opposite direction because either projections 264, 313 interfere or posts 760 interfere, and so face cap 20 cannot then be removed from housing 30. Preferably, one of projections (nubs) 264, 313 ratchets over another of projections (nubs) 313, 264 when face cap 20 is initially rotated from the unique initial orientation, thereby to lock face cap 20 onto housing 310 so that it cannot be removed without the use of a tool. In addition, posts 760 also limit rotation of face cap 20 when light 10 is fully assembled.

Seal 202 between circular ring 260 of face cap housing 210 and circular ring 312 of front housing 310 may be an O-ring or may be a shaped sealing ring, e.g., having a "C" shaped cross-sectional shape, and is optional. Seal 202 may provide a vent that permits the escape of gas from inside of housing 300.

In addition, visible in FIGS. 8, 3 and 4A is the "T-shaped" raised ridge or rail 326 on the top side of front housing 310, and rail 326 has a recess 319, e.g., a hexagonal recess 319, for receiving a threaded member 329 therein into which fastener 348 is threaded for securing slide 340 in a desired position on rail 326. Preferably, member 329 may be a nut into which fastener 348 threads or may be an insert and there may be a hole beneath recess 329 into which the threaded shank of fastener 348 may extend. Preferably and optionally, the threads of fastener 348 may be deformed after threaded member 329 is threaded thereon so that fastener 348 is captive and not easily removed from light 10.

Fastener, slide latch 340 has a shaped groove defined by inwardly directed flanges 344, 345 on the underside thereof that engage the corresponding outwardly directed flanges of T-shaped rail 326 for slidably retaining slide latch 340 thereon. The shank of fastener 348 is disposed in elongated slot 342 through slide latch 340 and the circular recess 343 at one end thereof receives the head of fastener 348 to secure slide latch 340 in the locked position for light housing assembly 30. Slide latch 340 also has one or more downwardly extending flanges 341 that ride over a raised ridge 328 or projection 328 of rear housing 320 for retaining and securing rear housing 320 against front housing 310 when slide latch 340 is moved to the locked position, and that release projection 328 when slide latch 340 is moved to the unlatched position.

Figure 9A:
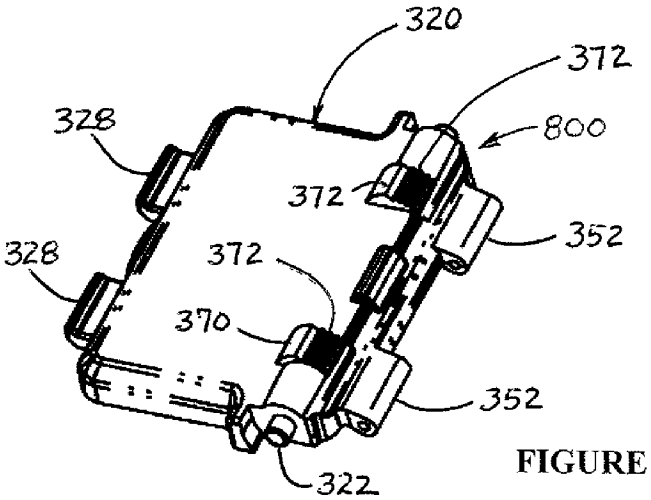
FIG. 9 includes FIGS. 9A and 9B which are a rear perspective view and a rear plan view, respectively, illustrating an example detent arrangement of the example light of FIGS. 1 and 2.
Figure 9B:
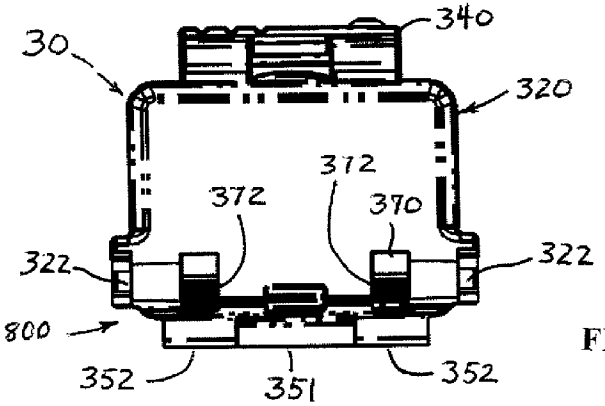
Figure 10B:
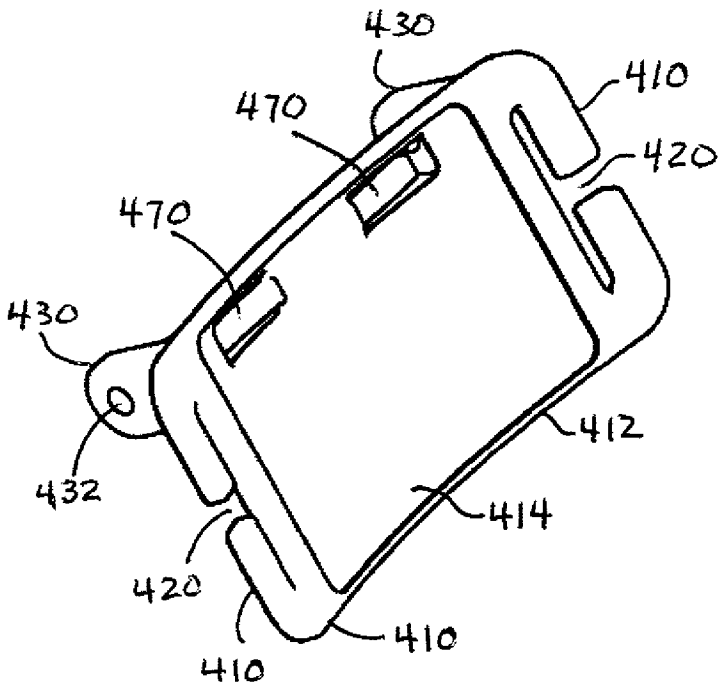
FIG. 10 includes FIG. 10A and FIG. 10B which are front and rear perspective views, respectively, of the example light mounting base of the example light illustrating the example detent arrangement thereof.
Figure 10A:
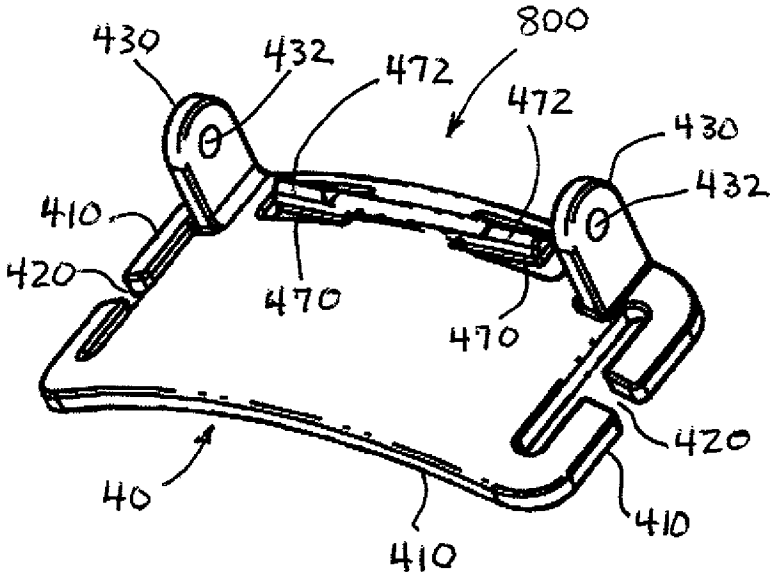

FIG. 9 includes FIGS. 9A and 9B which are a rear perspective view and a rear plan view, respectively, illustrating an example detent arrangement 800 of the example light 10 of FIGS. 1 and 2; and FIG. 10 includes FIG. 10A and FIG. 10B which are front and rear perspective views, respectively, of the example light mounting base 40 of the example light 10 illustrating the example detent arrangement 800 thereof. Detent arrangement 800 includes projections and recesses 370, 372 and 470,472 respectively located on rear housing cover 320 and on mount housing base 410 that are located to engage for providing a detent action when light body 30 is pivoted relative to mount 40, e.g., pivoted on the pivot joints provided by projecting coaxial pivot posts 322 being disposed in holes 432 of projecting members 430 of light base 410.

In one example embodiment, rear housing cover 320 of light body 30 has one or more curved projections 370 extending rearwardly towards mount 40. Each curved projection 370 preferably defines a generally circular arc about a central axis that is substantially the pivot axis of coaxial posts 322 and has one or more, and preferably a plurality of, projections and/or recesses, e.g., raised ridges 372, that are substantially parallel to the axis of coaxial posts 322 and that extend towards mount 40.

Typically, curved projections 370 and ridges 372 thereon, as well as coaxial pivot posts 322 may be integrally molded as part of rear housing cover 320. Integral molding thereof further serves to reduce potential alignment and tolerance issues relating to the pivotable mounting of light body 30 to mount 40 and the position of elements 370, 372 of detent 800 provided on light body 30, and eases maintaining a uniform degree of engagement between the various elements of detent 800 and the "feel" of detent 800.

In one example embodiment, light base 410 of mount 40 has one or more projections and/or recesses and/or ridges 472 extending forwardly towards light body 30 complementary to and engaging the raised projections and/or recesses and/or ridges 370, 372 of light body 30. Each projection 472 preferably lies on generally circular arc about the central axis that is substantially the pivot axis of coaxial posts 322 and has one or more raised ridges 472 that are substantially parallel to the pivot axis of coaxial posts 322 and extending towards light body 30.

Typically, the radius of the circle defined by ridges 372 of light body 30 and the radius of the circle defined by ridge or ridges 472 of mount 40 are substantially the same so that ridges 372, 472 engage or at least partially interfere, thereby to provide a detent 800 action for the pivoting of light body 30 relative to mount 40.

While ridges 472 could simply be provided as raised features on the curved convex surface of light base 410 of mount 40, it is preferable that ridges 472 be resiliently mounted relative to mount 40 so as to provide a relatively firm detent holding force while being resiliently movable to allow a relatively workable pivoting of light body 30 relative to mount 40. If detent 800 is too stiff, then light 10 may require two hands, one to hold light body 30 and one to hold mount 40, to pivot light body 30 relative to mount 40, which could be undesirable for a user to have to take both hands off of his work to adjust (pivot) head light 10.

To this end, one or more cantilevered beam members 470 may be provided on light base 410 to support ridges 472 in the desired locations on mounting light base 410 of mount 40 and relative to light body 30. Because light base 410 is curved, e.g., to more closely conform to the contour of a head, hat or helmet to which it may be mounted, ridges 472 are generally raised from the convex curve surface of light base 410. One or more cantilevered beam members 470 extend generally tangentially to the curve of light base 410 with their longitudinal direction substantially parallel to the pivot axis of coaxial pivot posts 322.

As a result, cantilevered beam members 470 can flex or bend to provide a resilient support for ridges 472 that allows ridges 472 to move relatively closer to and relatively farther away from ridges 372 of housing cover 320 of light body 30, thereby to ease the changing of relative positions of light body 30 and mount 40, e.g., the pivoting of light body 30 relative to mount 40.

Typically, cantilevered beam members 470 and ridges 472 thereon, as well as projecting members 430 having coaxial holes 432 therein and the slots 420 for band 450 are integrally molded as part of light base 410. Integral molding thereof further serves to reduce potential alignment and tolerance issues relating to the pivotable mounting of light body 30 to mount 40 and the positions of elements 470, 472 of detent 800 provided on mount 40, and eases maintaining a uniform degree of engagement between the various elements of detent 800 and the "feel" of detent 800.

In a typical embodiment of a light 10, light housings and parts 210, 310, 320, 340, 410, 510 and 700 may be a plastic, e.g. a nylon, ABS, polycarbonate, or acetal POM, or other suitable plastic, and lenses 240, 250 may be polycarbonate, or other suitable plastic. Face cap 20 may have an external ring, e.g., of rubber, silicone, TPE or TPV thermoplastic or vulcanized material, to provide a gripping surface. If circular member 700 is to be employed as a heat sink 700 it may be aluminum, brass, zinc, or copper, thermally loaded plastic or other suitable thermally conductive material. Conductors 520 may be aluminum, brass, copper, beryllium copper, music wire with a nickel or zinc plating, or other suitable electrically conductive material. Preferably, battery 530 employs plural single use alkaline or lithium battery cells, but may employ one or more rechargeable NiCd, NiMH or lithium-ion battery cells, and the battery cells may be in a size AA package or in a size AAA package, or may be in a custom package. Plastic and other non-electrically conductive materials may be lightly loaded with carbon or a form of carbon or other electrically conductive material so as to reduce static charge.

A portable light 10 may comprise: a light housing 300, 310, 320 for enclosing a source of electrical power; an electrical light source 600, 630 supported in the light housing 300, 310, 320; a face cap 20, 210 rotatably mounted to the light housing 300, 310, 320 and having one or more lenses 240, 250 for being positioned in front of the electrical light source 600, 630; a light source control circuit 600 interior the light housing 300, 310, 320, the control circuit 600 having one or more switch actuators 652 for selectively controlling the energization of the light source 600, 630; and an actuator member 314 on the face cap 20, 210, wherein rotating the face cap 20, 210 moves the actuator member 314 into one or more positions to actuate the one or more switch actuators 652, whereby rotating the face cap 20, 210 produces the selective energization of the light source 600, 630. The light housing 300, 310, 320 may include a front housing portion 310 and a rear housing portion 320 fastened together, wherein the front and rear housing portions 310, 320 cannot be separated without using a tool. The front housing portion 310 and rear housing portion 320 may be fastened together by one or more fasteners that cannot be removed without using a tool or by a slide member 340 that is secured in a closed position by a fastener 348 that cannot be removed without using a tool. The actuator member 314 may include a spring loaded ball 314. The portable light 10 may further comprise a circular member 700 having two or more openings therein and a switch actuator 652 in at least one of the two or more openings, wherein when the face cap 20, 210 is rotated into a position to energize the light source 600, 630, the actuator member 314 is disposed at least partly in one of the openings having a switch actuator 652 therein. The actuator member 314 may actuate the switch actuator 652 in the one of the openings having a switch actuator 652 therein, thereby to cause the control circuit 600 to apply electrical power from the source of electrical power to energize the light source 600, 630. The light housing 300, 310, 320 and the face cap 20, 210 may each have spaced apart projections thereof in complementary patterns, wherein the face cap 20, 210 may be seated on the light housing 300, 310, 320 with the complementary projections passing one another, and wherein rotating the face cap 20, 210 relative to the light housing 300, 310, 320 causes the face cap 20, 210 to become retained thereon. The face cap 20, 210 once retained on the light housing 300, 310, 320 may not be removable from the light housing 300, 310, 320 without using a tool. The one or more lenses 240, 250 may include a clear lens, a diffusing lens, a color filter, an optical filter, or a combination thereof. The one or more lenses 240, 250 may include a clear lens producing a relative narrow spot beam and a diffusing lens producing a relatively broad flood beam.

A portable light 10 may comprise: a light housing 300, 310, 320 for enclosing a source of electrical power, the light housing 300, 310, 320 including a front housing portion 310 and a rear housing portion 320 fastened together, wherein the front and rear housing portions 310, 320 cannot be separated without using a tool; an electrical light source 600, 630 supported in the light housing 300, 310, 320; a face cap 20, 210 rotatably mounted to the light housing 300, 310, 320 and having one or more lenses 240, 250 for being positioned in front of the electrical light source 600, 630, wherein the face cap 20, 210 once retained on the light housing 300, 310, 320 cannot be removed from the light housing 300, 310, 320 without using a tool; a light source control circuit 600 interior the light housing 300, 310, 320, the control circuit 600 having one or more switch actuators 652 for selectively controlling the energization of the light source 600, 630; and an actuator member 314 on the face cap 20, 210, wherein rotating the face cap 20, 210 moves the actuator member 314 into one or more positions to actuate the one or more switch actuators 652, whereby rotating the face cap 20, 210 produces the selective energization of the light source 600, 630. The front housing portion 310 and rear housing portion 320 may be fastened together by one or more fasteners that cannot be removed without using a tool or by a slide member 340 that is secured in a closed position by a fastener 348 that cannot be removed without using a tool. The actuator member 314 may include a spring loaded ball 314. The portable light 10 may further comprise a circular member 700 having two or more openings therein and a switch actuator 652 in at least one of the two or more openings, wherein when the face cap 20, 210 is rotated into a position to energize the light source 600, 630, the actuator member 314 is disposed at least partly in one of the openings having a switch actuator 652 therein. The actuator member 314 may actuate the switch actuator 652 in the one of the openings having a switch actuator 652 therein, thereby to cause the control circuit 600 to apply electrical power from the source of electrical power to energize the light source 600, 630. The light housing 300, 310, 320 and the face cap 20, 210 may each have spaced apart projections thereof in complementary patterns, wherein the face cap 20, 210 may be seated on the light housing 300, 310, 320 with the complementary projections passing one another, and wherein rotating the face cap 20, 210 relative to the light housing 300, 310, 320 causes the face cap 20, 210 to become retained thereon. The one or more lenses 240, 250 may include a clear lens, a diffusing lens, a color filter, an optical filter, or a combination thereof. The one or more lenses 240, 250 may include a clear lens producing a relative narrow spot beam and a diffusing lens producing a relatively broad flood beam.

A portable light 10 may comprise: a light housing 30, 310, 320 for enclosing a source of electrical power; an electrical light source 600, 630 supported in the light housing 30, 310, 320; a face cap 20 rotatably mounted to the light housing 30, 310, 320 and having one or more lenses 240, 250 for being positioned in front of the electrical light source 600, 630; a light source control circuit 600 interior the light housing 30, 310, 320, the control circuit 600 having one or more switch actuators 652 for selectively controlling the energization of the light source 600, 630; and an actuator member 314 of the face cap 20, wherein rotating the face cap 20 moves the actuator member 314 into one or more positions to actuate the one or more switch actuators 652, whereby rotating the face cap 20 produces the selective energization of the light source 600, 630. The light housing 30, 310, 320 may include a front housing portion 310 and a rear housing portion 320 fastened together, wherein the front and rear housing portion 320s cannot be separated without using a tool. The light housing 30, 310, 320 may include a front housing portion 310 and a rear housing portion 320 fastened together by one or more fasteners that cannot be removed without using a tool or by a slide member 340 that is secured in a closed position by a fastener that cannot be removed without using a tool. The actuator member 314 may include a spring loaded ball. The portable light 10 may further comprise a circular member 700 within the light housing 30, 310, 320 and having two or more openings therein and a switch actuator 652 in at least one of the two or more openings, wherein when the face cap 20 is rotated into a position to energize the light source 600, 630, the actuator member 314 is disposed at least partly in one of the openings having a switch actuator 652 therein. The actuator member 314 may actuate the switch actuator 652 in the one of the openings having a switch actuator 652 therein, thereby to cause the control circuit 600 to apply electrical power from the source of electrical power to energize the light source 600, 630. The light housing 30, 310, 320 and the face cap 20 each may have spaced apart projections thereof in complementary patterns, wherein the face cap 20 may be seated on the light housing 30, 310, 320 with the complementary projections passing one another, and wherein rotating the face cap 20 relative to the light housing 30, 310, 320 causes the face cap 20 to become retained thereon. The face cap 20 once retained on the light housing 30, 310, 320 cannot be removed from the light housing 30, 310, 320 without using a tool. The one or more lenses 240, 250 may include a clear lens, a diffusing lens, a color filter, an optical filter, or a combination thereof. The one or more lenses 240, 250 may include a clear lens producing a relative narrow spot beam and a diffusing lens producing a relatively broad flood beam. The light housing 30, 310, 320 may be pivotably mounted to a base 410, wherein: the base 410 may be shaped to generally conform with an object to which the portable light is intended to be mounted; or the base 410 may have a plurality of slots for receiving a band or strap 450; or the base 410 may have a pad or cushion on a surface thereof remote from the light housing 30, 310, 320; or any combination of the foregoing. The portable light 10 may include a pivotable mount 322, 430 pivotably mounting the light housing 30, 310, 320 to a base 410, and may further include a detent having complementary detent features on the light housing 30, 310, 320 and on the base 410 for retaining the light housing 30, 310, 320 and the base 410 in a pivot position. The detent may include a plurality of detent features in an arc on the light housing 30, 310, 320 and one or more detent features on a cantilevered member 470 extending from the base 410. The detent may include a cantilevered member 470 extending generally tangentially to the base 410 with a longitudinal direction substantially parallel to a pivot axis of the pivotable mount 322, 430.

A portable light 10 may comprise: a light housing 30, 310, 320 for enclosing a source of electrical power, the light housing 30, 310, 320 including a front housing portion 310 and a rear housing portion 320 fastened together, wherein the front and rear housing portions 310, 320 cannot be separated without using a tool; an electrical light source 600, 630 supported in the light housing 30, 310, 320; a face cap 20 rotatably mounted to the light housing 30, 310, 320 and having one or more lenses 240, 250 for being positioned in front of the electrical light source 600, 630, wherein the face cap 20 once retained on the light housing 30, 310, 320 cannot be removed from the light housing 30, 310, 320 without using a tool; a light source control circuit 600 interior the light housing 30, 310, 320, the control circuit 600 having one or more switch actuators 652 for selectively controlling the energization of the light source 600, 630; and an actuator member 314 of the face cap 20, wherein rotating the face cap 20 moves the actuator member 314 into one or more positions to actuate the one or more switch actuators 652, whereby rotating the face cap 20 produces the selective energization of the light source 600, 630. The front housing portion 310 and rear housing portion 320 may be fastened together by one or more fasteners that cannot be removed without using a tool or by a slide member 340 that may be secured in a closed position by a fastener that cannot be removed without using a tool. The actuator member 314 may include a spring loaded ball. The portable light 10 may further comprise a circular member 700 within the light housing 30, 310, 320 and having two or more openings therein and a switch actuator 652 in at least one of the two or more openings, wherein when the face cap 20 may be rotated into a position to energize the light source 600, 630, the actuator member 314 is disposed at least partly in one of the openings having a switch actuator 652 therein. The actuator member 314 may actuate the switch actuator 652 in the one of the openings having a switch actuator 652 therein, thereby to cause the control circuit 600 to apply electrical power from the source of electrical power to energize the light source 600, 630. The light housing 30, 310, 320 and the face cap 20 may each have spaced apart projections thereof in complementary patterns, wherein the face cap 20 may be seated on the light housing 30, 310, 320 with the complementary projections passing one another, and wherein rotating the face cap 20 relative to the light housing 30, 310, 320 causes the face cap 20 to become retained thereon. The one or more lenses 240, 250 may include a clear lens, a diffusing lens, a color filter, an optical filter, or a combination thereof. The one or more lenses 240, 250 may include a clear lens producing a relative narrow spot beam and a diffusing lens producing a relatively broad flood beam. The light housing 30, 310, 320 may be pivotably mounted to a base 410, wherein: the base 410 may be shaped to generally conform with an object to which the portable light is intended to be mounted; or the base 410 may have a plurality of slots for receiving a band or strap 450; or the base 410 may have a pad or cushion on a surface thereof remote from the light housing 30, 310, 320; or any combination of the foregoing. The portable light 10 may include a pivotable mount 322, 430 pivotably mounting the light housing 30, 310, 320 to a base 410, and may further include a detent having complementary detent features on the light housing 30, 310, 320 and on the base 410 for retaining the light housing 30, 310, 320 and the base 410 in a pivot position. The detent may include a plurality of detent features in an arc on the light housing 30, 310, 320 and one or more detent features on a cantilevered member 470 extending from the base 410. The detent may include a cantilevered member 470 extending generally tangentially to the base 410 with a longitudinal direction substantially parallel to a pivot axis of the pivotable mount 322, 430.

A portable light 10 may comprise: a light housing 30, 310, 320 for enclosing a source of electrical power, the light housing 30, 310, 320 including a front housing portion 310 and a rear housing portion 320 fastened together; an electrical light source 600, 630 supported in the light housing 30, 310, 320; the light housing 30, 310, 320 including a face cap 20 mounted thereto having at least one lens positioned in front of the electrical light source 600, 630; a light source control circuit 600 interior the light housing 30, 310, 320, the control circuit 600 having a switch actuator 652 for selectively controlling the energization of the light source 600, 630; and actuatable from exterior the light housing 30, 310, 320; a curved light base 410 including at least one cantilevered flexible member 470 extending therefrom in a direction generally tangential to the curve of the curved light base 410; a pivotable mount 322, 430 pivotably mounting the light housing 30, 310, 320 to the curved light base 410; and a detent having complementary detent features on the light housing 30, 310, 320 and on the at least one cantilevered flexible member 470 of the curved light base 410 for retaining the light housing 30, 310, 320 and the curved light base 410 in a pivot position. The front housing portion 310 and rear housing portion 320 may be fastened together by one or more fasteners that cannot be removed without using a tool or by a slide member 340 that is secured in a closed position by a fastener that cannot be removed without using a tool. In the portable light 10: the face cap 20 may be rotatably mounted to the light housing 30, 310, 320, or the face cap 20 may be rotatably mounted to the light housing 30, 310, 320 and has one or more lenses 240, 250 for being positioned in front of the electrical light source 600, 630; or. the face cap 20 may be rotatably mounted to the light housing 30, 310, 320 and rotating the face cap 20 actuates the switch actuator 652 for selectively controlling the energization of the light source 600, 630, or the face cap 20 may be rotatably mounted to the light housing 30, 310, 320, has one or more lenses 240, 250 for being positioned in front of the electrical light source 600, 630, and rotating the face cap 20 actuates the switch actuator 652 for selectively controlling the energization of the light source 600, 630. The face cap 20 may be rotatably mounted to the light housing 30, 310, 320, and/or the face cap 20 once retained on the light housing 30, 310, 320 cannot be removed from the light housing 30, 310, 320 without using a tool.

A portable light may comprise: a light housing 30, 310, 320 including first and second housing parts 310, 320 for enclosing a source of electrical power; the light housing 30, 310, 320 including a light source 600, 630 for directing light outwardly from the light housing 30, 310, 320 when energized and a switch 650, 652 for selectively energizing the light source 600, 630; a rail 326 on one of the first and second housing parts 310, 320; a slide latch 340 slidable on the rail 326 between latched and unlatched positions; a projection 328 on the other one of the first and second housing parts 310, 320, wherein the projection 328 is proximate the slide latch 340 when the first and second housing parts 310, 320 are adjacent each other to define the light housing 30, 310, 320; wherein when the first and second housing parts 310, 320 are adjacent each other and the slide latch 340 is moved to the latched position, the slide latch 340 engages the projection 328, thereby to prevent separation of the first and second housing parts 310, 320, and wherein when the slide latch 340 is moved to the unlatched position, the slide latch 340 disengages from the projection 328, thereby to release the first and second housing parts 310, 320 to be separated. The rail 326 may include a T-shaped ridge 326 and wherein the slide latch 340 has a flange for engaging the T-shaped ridge 326 to be slidable on the rail 326 between the latched and unlatched positions. The T-shaped ridge 326 may be defined by opposing outwardly directed flanges and wherein the flange of the slide latch 340 may include opposing inwardly directed flanges configured for engaging the outwardly directed flanges of the T-shaped ridge 326. The slide latch 340 may have a longitudinal slot 342 therein, the light housing 30, 310, 320 further including a fastener 348 extending therefrom through the longitudinal slot 342 of the slide latch 340, the fastener 348 having a head that is movable to engage the slide latch 340 when the slide latch 340 is in the latched position. The longitudinal slot 342 may have a recess at one location thereof, wherein rotating the fastener 348 in a first direction when the slide latch 340 is in the latched position causes the head thereof to move into the recess of the longitudinal slot 342 and rotating the fastener 348 in an opposite direction causes the head of the fastener 348 to move away from the slide latch 340. The portable light of claim 4 wherein the fastener 348 has an interface configured: for receiving a tool; or for receiving a tool other than a flat blade or Phillips screwdriver. The rail 326 may have: a threaded recess 329 for receiving the fastener 348; or a recess for receiving a nut 329 that is threaded for receiving the fastener 348. The light housing 30, 310, 320 may include a hinge 350 joining the first and second housing parts 310, 320 at a location opposite to the position of the rail 326 and the projection 328. The light housing 30, 310, 320 may further comprise: a face cap 20, 210 rotatably mounted to the light housing 30, 310, 320 and configured for rotation to position one or more lenses 240, 250 in front of the light source 600, 630; a light source control circuit 600 interior the light housing 30, 310, 320 and responsive to the rotational position of the face cap 20, 210 for selectively controlling the energization of the light source 600, 630; whereby rotating the face cap 20, 210 produces the selective energization of the light source 600, 630. The portable light wherein the light source control circuit 600 may include one or more switch actuators 652 for selectively controlling the energization of the light source 600, 630; wherein the face cap 20, 210 may include an actuator member, and wherein rotating the face cap 20, 210 moves the actuator member into one or more positions to actuate the one or more switch actuators 652 for producing the selective energization of the light source 600, 630. The light housing 30, 310, 320 and the face cap 20, 210 may each have spaced apart projections 328 thereof in complementary patterns, wherein the face cap 20, 210 may be seated on the light housing 30, 310, 320 with the complementary projections 328 passing one another, and wherein rotating the face cap 20, 210 relative to the light housing 30, 310, 320 causes the face cap 20, 210 to become retained thereon. The face cap 20, 210 once retained on the light housing 30, 310, 320 preferably cannot be removed from the light housing 30, 310, 320 without using a tool. The one or more lenses 240, 250 include a clear lens, a diffusing lens, a color filter, an optical filter, or a combination thereof. The light housing 30, 310, 320 may be pivotably mounted to a base 410: wherein the base 410 is shaped to generally conform with an object to which the portable light is intended to be mounted; or wherein the base 410 has a plurality of slots 420 for receiving a band or strap; or wherein the base 410 has a pad or cushion 414 on a surface thereof remote from the light housing 30, 310, 320; or any combination of the foregoing. The portable light may further include a pivotable mount 40 pivotably mounting the light housing 30, 310, 320 to a base 410, the pivotable mount 40 including a detent 800 having complementary detent features on the light housing 30, 310, 320 and on the base 410 for retaining the light housing 30, 310, 320 and the base 410 in a pivot position. The detent 800 may include a cantilevered member 470 extending generally tangentially to the base 410 with a longitudinal direction substantially parallel to a pivot axis of the pivotable mount 40. The detent 8000 may include a plurality of detent features 372 in an arc on the light housing 30, 310, 320 and one or more detent features 472 on a cantilevered member 470 extending from the base 410.

A portable light may comprise: a light housing 30, 310, 320 including first and second housing parts 310, 320 for enclosing a source of electrical power; the light housing 30, 310, 320 including a light source 600, 630 for directing light outwardly from the light housing 30, 310, 320 when energized and a switch 650, 652 for selectively energizing the light source 600, 630; a slide latch 340 slidable on one of the first and second housing parts 310, 320 between a latched position and an unlatched position; a fastener 348 configured for securing the slide latch 340 in the latched position; a projection 328 on the other one of the first and second housing parts 310, 320, wherein the projection 328 is proximate the slide latch 340 when the first and second housing parts 310, 320 are adjacent each other to define the light housing 30, 310, 320; wherein when the first and second housing parts 310, 320 are adjacent each other and the slide latch 340 is moved to the latched position, the slide latch 340 engages the projection 328, thereby to prevent separation of the first and second housing parts 310, 320, wherein the slide latch 340 is securable in the latched position by the fastener 348, and wherein when the fastener 348 is not secured by the fastener 348 and the slide latch 340 is moved to the unlatched position, the slide latch 340 disengages from the projection 328, thereby to release the first and second housing parts 310, 320 to be separated. The slide latch 340 may have a longitudinal slot 342 therein, the light housing 30, 310, 320 further including a fastener 348 extending therefrom through the longitudinal slot 342 of the slide latch 340, the fastener 348 having a head that is movable to engage the slide latch 340 when the slide latch 340 is in the latched position. The longitudinal slot 342 may have a recess at one location thereof, wherein rotating the fastener 348 in a first direction when the slide latch 340 is in the latched position causes the head thereof to move into the recess of the longitudinal slot 342 and rotating the fastener 348 in an opposite direction causes the head of the fastener 348 to move away from the slide latch 340. The fastener 348 may have an interface configured: for receiving a tool; or for receiving a tool other than a flat blade or Phillips screwdriver. The slide latch 340 may be slidable on a rail 326 on the one of the first and second housing parts 310, 320. The rail 326 may include a T-shaped ridge 326 and wherein the slide latch 340 may have a flange for engaging the T-shaped ridge 326 to be slidable on the rail 326 between the latched and unlatched positions. The T-shaped ridge 326 may be defined by opposing outwardly directed flanges and wherein the flange of the slide latch 340 may include opposing inwardly directed flanges configured for engaging the outwardly directed flanges of the T-shaped ridge 326. The rail 326 may have: a threaded recess for receiving the fastener 348; or a recess for receiving a nut that is threaded for receiving the fastener 348. The light housing 30, 310, 320 may include a hinge 350 joining the first and second housing parts 310, 320 at a location opposite to the position of the slide latch 340 and the projection 328. The light housing 30, 310, 320 may further comprise: a face cap 20, 210 rotatably mounted to the light housing 30, 310, 320 and configured for rotation to position one or more lenses 240, 250 in front of the light source 600, 630; a light source control circuit 600 interior the light housing 30, 310, 320 and responsive to the rotational position of the face cap 20, 210 for selectively controlling the energization of the light source 600, 630; whereby rotating the face cap 20, 210 produces the selective energization of the light source 600, 630. The portable light: wherein the light source control circuit 600 may include one or more switch actuators 652 for selectively controlling the energization of the light source 600, 630; and wherein the face cap 20, 210 may include an actuator member, wherein rotating the face cap 20, 210 moves the actuator member into one or more positions to actuate the one or more switch actuators 652 for producing the selective energization of the light source 600, 630. The light housing 30, 310, 320 and the face cap 20, 210 may each have spaced apart projections 328 thereof in complementary patterns, wherein the face cap 20, 210 may be seated on the light housing 30, 310, 320 with the complementary projection 328s passing one another, and wherein rotating the face cap 20, 210 relative to the light housing 30, 310, 320 causes the face cap 20, 210 to become retained thereon. The face cap 20, 210 once retained on the light housing 30, 310, 320 preferably cannot be removed from the light housing 30, 310, 320 without using a tool. The one or more lenses 240, 250 may include a clear lens, a diffusing lens, a color filter, an optical filter, or a combination thereof. The light housing 30, 310, 320 may be pivotably mounted to a base 410: wherein the base 410 may be shaped to generally conform with an object to which the portable light is intended to be mounted; or wherein the base 410 has a plurality of slots 420 for receiving a band or strap; or wherein the base has a pad or cushion 414 on a surface thereof remote from the light housing 30, 310, 320; or any combination of the foregoing. The portable light may further include a pivotable mount 40 pivotably mounting the light housing 30, 310, 320 to a base 410, the pivotable mount 40 including a detent 800 having complementary detent features on the light housing 30, 310, 320 and on the base 410 for retaining the light housing 30, 310, 320 and the base 410 in a pivot position. The detent 800 may include a cantilevered member 470 extending generally tangentially to the base 410 with a longitudinal direction substantially parallel to a pivot axis of the pivotable mount 40. The detent may include a plurality of detent features 372 in an arc on the light housing 30, 310, 320 and one or more detent features 472 on a cantilevered member 470 extending from the base 410.

A portable light may comprise: a light housing 30, 310, 320 including front and rear housing parts 310, 320 for enclosing a source of electrical power; the light housing 30, 310, 320 including a light source 600, 630 for directing light outwardly from the light housing 30, 310, 320 when energized and a switch 650, 652 for selectively energizing the light source 600, 630; a face cap 20, 210 rotatably mounted to the front housing part 310 and configured for rotation to position one or more lenses 240, 250 in front of the light source 600, 630; a light source control circuit 600 interior the light housing 30, 310, 320 and responsive to the rotational position of the face cap 20, 210 for selectively controlling the energization of the light source 600, 630, whereby rotating the face cap 20, 210 produces the selective energization of the light source 600, 630; a rail 326 including a T-shaped ridge 326 on one of the front and rear housing parts 310, 320; a slide latch 340 having a flange for engaging the T-shaped ridge 326 to be slidable on the rail 326 between latched and unlatched positions and having a longitudinal slot 342; a fastener 348 extending from the light housing 30, 310, 320 through the longitudinal slot 342 of the slide latch 340, the fastener 348 having a head that is movable to engage the slide latch 340 when the slide latch 340 is in the latched position; a projection 328 on the other one of the front and rear housing parts 310, 320, wherein the projection 328 is proximate the slide latch 340 when the front and rear housing parts 310, 320 are adjacent each other to define the light housing 30, 310, 320; wherein when the front and rear housing parts 310, 320 are adjacent each other and the slide latch 340 is moved to the latched position, the slide latch 340 engages the projection 328, thereby to prevent separation of the front and rear housing parts 310, 320, and wherein when the fastener 348 is not secured by the fastener 348 and the slide latch 340 is moved to the unlatched position, the slide latch 340 disengages from the projection 328, thereby to release the front and rear housing parts 310, 320 to be separated. The one or more lenses 240, 250 include a clear lens, a diffusing lens, a color filter, an optical filter, or a combination thereof. The rear housing part 320 may be pivotably mounted to a base 410: wherein the base 410 is shaped to generally conform with an object to which the portable light is intended to be mounted; or wherein the base 410 has a plurality of slots 420 for receiving a band or strap; or wherein the base 410 has a pad or cushion 414 on a surface thereof remote from the light housing 30, 310, 320; or any combination of the foregoing.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "up," "down," "left," "right," "front," "rear," "side," "end," "top," "bottom," "forward," "backward," "under" and/or "over," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

Further, tool interface may be used to refer generally to any interface suitable for engaging or being engaged by a tool, and need not be a recess, e.g., as would receive a hexagonal or Allen wrench or spined tool. Such tool interface can be a projection or other feature that receives a tool having a recess or socket, e.g., a triangular, square or hexagonal nut driver, and the like.

The term battery is used herein to refer to an electrochemical device comprising one or more electro-chemical cells and/or fuel cells, and so a battery may include a single cell or plural cells, whether as individual units or as a packaged unit. A battery is one example of a type of an electrical power source suitable for a portable device.

While the present invention has been described in terms of the foregoing example embodiments, variations within the scope and spirit of the present invention as defined by the claims following will be apparent to those skilled in the art. For example, light source 630 may include one or more light emitting diodes, e.g., having different light outputs, providing light of different colors, and the like, that may be actuated individually or in groups of two or more at the different rotational actuation positions of face cap 20, 210.

While the example embodiment of light 10 includes one OFF position at center and two ON positions clockwise and counter clockwise over the rotation range of face cap 20, 210, other arrangements are contemplated. For example, the OFF position may be at one end of the rotational range of face cap 20, 210 and two or more ON positions may be provided at two or more rotational positions that are arranged clockwise and/or counter clockwise in rotation of face cap 20, 210 therefrom. In addition, one or more further electrical switches may be provided with actuators actuatable from exterior to light body 30 for enabling user operation, control and/or programming of the operation of light 10, e.g., and of one or more LEDs 630 therein.

Alternatively, the tool interface 348T of fasteners 348 may have a relatively simple or common shape, such as a slot for receiving a flat blade screwdriver or a cruciform shape (a cross "+" shape) for receiving a cross-shaped tool, e.g., a Philip's head screwdriver, or interface or receptacle 348T may have a more complex shape, e.g., such as a hexagonal shape for receiving a hexagonal tool, e.g., an Allen wrench, or may have a ribbed wall for receiving a ribbed tool, e.g., a Torx® driver tool, or may have spaced apart recesses for receiving a tool having spaced apart pins, e.g., a spanner wrench, or another less common tool, or even a non-standard or special tool. Moreover, the light or device 10 may have a receptacle or other feature for storing the tool, may have a tool that is connected, e.g., via a tether or lanyard, or may have a tool intended to be kept separate from the light or device, e.g., in a non-hazardous area or under the control of a supervisor or other responsible or designated person.

Alternatively, one or more fasteners may secure rear housing (cover) 320 to front housing 310 and may be held captive in respective holes at opposite ends of rear housing 320 and engage respective holes in front housing 310. Preferably, and optionally, inserts may be pressed or molded into front housing 310 to receive these fasteners therein. Where the fasteners are, e.g., screws, inserts therefor, if any, are typically metal and correspondingly threaded, and where the fasteners are, e.g., drive pins, inserts therefor, if any, may be a deformable metal or plastic. The fasteners may have a tool interface at one end thereof for receiving a tool for rotating and removing the fastener. Where light 10 is intended to be usable in hazardous environments, the fasteners are only removable by a tool, preferably an uncommon, non-standard or special tool, as described.

While two different means for securing the rear housing 320 to front housing 310 are described, e.g., one employing a slide clasp and another employing fasteners, other arrangements are contemplated, e.g., a single fastener, a snap-on snap-off cover 320, a slide on cover 320, and the like.

Further, while it is preferred that the housing assembly 30 with face cap 20 thereon be sealed and to be openable only by using a tool, e.g., so as to be suitable for use in a hazardous environment, seals may be provided only to resist intrusion of moisture and debris or may be omitted. Likewise, a housing assembly 30 may be provided that is openable without using a tool.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A portable light comprising:

a light housing including first and second housing parts for enclosing a source of electrical power;

said light housing including a light source for directing light outwardly from said light housing when energized and a switch for selectively energizing the light source;

a rail on one of said first and second housing parts;

a slide latch slidable on said rail between latched and unlatched positions;

a projection on the other one of said first and second housing parts, wherein said projection is proximate said slide latch when said first and second housing parts are adjacent each other to define said light housing;

wherein when said first and second housing parts are adjacent each other and said slide latch is moved to the latched position, said slide latch engages said projection, thereby to prevent separation of said first and second housing parts, and wherein when said slide latch is moved to the unlatched position, said slide latch disengages from said projection, thereby to release said first and second housing parts to be separated.

2. The portable light of claim 1 wherein said rail includes a T-shaped ridge and wherein said slide latch has a flange for engaging the T-shaped ridge to be slidable on said rail between the latched and unlatched positions.

3. The portable light of claim 2 wherein said T-shaped ridge is defined by opposing outwardly directed flanges and wherein the flange of said slide latch includes opposing inwardly directed flanges configured for engaging the outwardly directed flanges of said T-shaped ridge.

4. The portable light of claim 1 wherein said slide latch has a longitudinal slot therein, said light housing further including a fastener extending therefrom through the longitudinal slot of said slide latch, said fastener having a head that is movable to engage said slide latch when said slide latch is in the latched position.

5. The portable light of claim 4 wherein the longitudinal slot has a recess at one location thereof, wherein rotating said fastener in a first direction when said slide latch is in the latched position causes the head thereof to move into the recess of the longitudinal slot and rotating said fastener in an opposite direction causes the head of said fastener to move away from said slide latch.

6. The portable light of claim 4 wherein said fastener has an interface configured:

for receiving a tool; or for receiving a tool other than a flat blade or Phillips screwdriver.

7. The portable light of claim 4 wherein said rail has:

a threaded recess for receiving said fastener; or a recess for receiving a nut that is threaded for receiving said fastener.

8. The portable light of claim 1 wherein said light housing includes a hinge joining said first and second housing parts at a location opposite to the position of said rail and said projection.

9. The portable light of claim 1 wherein said light housing further comprises:

a face cap rotatably mounted to said light housing and configured for rotation to position one or more lenses in front of said light source;

a light source control circuit interior said light housing and responsive to the rotational position of said face cap for selectively controlling the energization of said light source;

whereby rotating said face cap produces the selective energization of said light source.

10. The portable light of claim 9:

wherein said light source control circuit includes one or more switch actuators for selectively controlling the energization of said light source;

wherein said face cap includes an actuator member, and wherein rotating said face cap moves said actuator member into one or more positions to actuate the one or more switch actuators for producing the selective energization of said light source.

11. The portable light of claim 9 wherein said light housing and said face cap each have spaced apart projections thereof in complementary patterns, wherein said face cap may be seated on said light housing with the complementary projections passing one another, and wherein rotating said face cap relative to said light housing causes said face cap to become retained thereon.

12. The portable light of claim 11 wherein said face cap once retained on said light housing cannot be removed from said light housing without using a tool.

13. The portable light of claim 9 wherein the one or more lenses include a clear lens, a diffusing lens, a color filter, an optical filter, or a combination thereof.

14. The portable light of claim 1 wherein said light housing is pivotably mounted to a base:

wherein said base is shaped to generally conform with an object to which said portable light is intended to be mounted; or wherein said base has a plurality of slots for receiving a band or strap; or wherein said base has a pad or cushion on a surface thereof remote from said light housing; or any combination of the foregoing.

15. The portable light of claim 1 further including a pivotable mount pivotably mounting said light housing to a base, said pivotable mount including a detent having complementary detent features on said light housing and on said base for retaining said light housing and said base in a pivot position.

16. The portable light of claim 15 wherein said detent includes a cantilevered member extending generally tangentially to said base with a longitudinal direction substantially parallel to a pivot axis of the pivotable mount.

17. The portable light of claim 15 wherein said detent includes a plurality of detent features in an arc on said light housing and one or more detent features on a cantilevered member extending from said base.

18. A portable light comprising:

a light housing including first and second housing parts for enclosing a source of electrical power;

said light housing including a light source for directing light outwardly from said light housing when energized and a switch for selectively energizing the light source;

a slide latch slidable on one of said first and second housing parts between a latched position and an unlatched position;

a fastener configured for securing said slide latch in the latched position;

a projection on the other one of said first and second housing parts, wherein said projection is proximate said slide latch when said first and second housing parts are adjacent each other to define said light housing;

wherein when said first and second housing parts are adjacent each other and said slide latch is moved to the latched position, said slide latch engages said projection, thereby to prevent separation of said first and second housing parts, wherein said slide latch is securable in the latched position by said fastener, and wherein when said fastener is not secured by said fastener and said slide latch is moved to the unlatched position, said slide latch disengages from said projection, thereby to release said first and second housing parts to be separated.

19. The portable light of claim 18 wherein said slide latch has a longitudinal slot therein, said light housing further including a fastener extending therefrom through the longitudinal slot of said slide latch, said fastener having a head that is movable to engage said slide latch when said slide latch is in the latched position.

20. The portable light of claim 19 wherein the longitudinal slot has a recess at one location thereof, wherein rotating said fastener in a first direction when said slide latch is in the latched position causes the head thereof to move into the recess of the longitudinal slot and rotating said fastener in an opposite direction causes the head of said fastener to move away from said slide latch.

21. The portable light of claim 19 wherein said fastener has an interface configured:

for receiving a tool; or for receiving a tool other than a flat blade or Phillips screwdriver.

22. The portable light of claim 18 wherein said slide latch is slidable on a rail on the one of said first and second housing parts.

23. The portable light of claim 22 wherein said rail includes a T-shaped ridge and wherein said slide latch has a flange for engaging the T-shaped ridge to be slidable on said rail between the latched and unlatched positions.

24. The portable light of claim 23 wherein said T-shaped ridge is defined by opposing outwardly directed flanges and wherein the flange of said slide latch includes opposing inwardly directed flanges configured for engaging the outwardly directed flanges of said T-shaped ridge.

25. The portable light of claim 17 wherein said rail has:

a threaded recess for receiving said fastener; or a recess for receiving a nut that is threaded for receiving said fastener.

26. The portable light of claim 18 wherein said light housing includes a hinge joining said first and second housing parts at a location opposite to the position of said slide latch and said projection.

27. The portable light of claim 18 wherein said light housing further comprises:

a face cap rotatably mounted to said light housing and configured for rotation to position one or more lenses in front of said light source;

a light source control circuit interior said light housing and responsive to the rotational position of said face cap for selectively controlling the energization of said light source;

whereby rotating said face cap produces the selective energization of said light source.

28. The portable light of claim 27:

wherein said light source control circuit includes one or more switch actuators for selectively controlling the energization of said light source;

wherein said face cap includes an actuator member, and wherein rotating said face cap moves said actuator member into one or more positions to actuate the one or more switch actuators for producing the selective energization of said light source.

29. The portable light of claim 27 wherein said light housing and said face cap each have spaced apart projections thereof in complementary patterns, wherein said face cap may be seated on said light housing with the complementary projections passing one another, and wherein rotating said face cap relative to said light housing causes said face cap to become retained thereon.

30. The portable light of claim 29 wherein said face cap once retained on said light housing cannot be removed from said light housing without using a tool.

31. The portable light of claim 27 wherein the one or more lenses include a clear lens, a diffusing lens, a color filter, an optical filter, or a combination thereof.

32. The portable light of claim 18 wherein said light housing is pivotably mounted to a base:

wherein said base is shaped to generally conform with an object to which said portable light is intended to be mounted; or wherein said base has a plurality of slots for receiving a band or strap; or wherein said base has a pad or cushion on a surface thereof remote from said light housing; or any combination of the foregoing.

33. The portable light of claim 18 further including a pivotable mount pivotably mounting said light housing to a base, said pivotable mount including a detent having complementary detent features on said light housing and on said base for retaining said light housing and said base in a pivot position.

34. The portable light of claim 33 wherein said detent includes a cantilevered member extending generally tangentially to said base with a longitudinal direction substantially parallel to a pivot axis of the pivotable mount.

35. The portable light of claim 33 wherein said detent includes a plurality of detent features in an arc on said light housing and one or more detent features on a cantilevered member extending from said base.

36. A portable light comprising:

a light housing including front and rear housing parts for enclosing a source of electrical power;

said light housing including a light source for directing light outwardly from said light housing when energized and a switch for selectively energizing the light source;

a face cap rotatably mounted to said front housing part and configured for rotation to position one or more lenses in front of said light source;

a light source control circuit interior said light housing and responsive to the rotational position of said face cap for selectively controlling the energization of said light source, whereby rotating said face cap produces the selective energization of said light source;

a rail including a T-shaped ridge on one of said front and rear housing parts;

a slide latch having a flange for engaging the T-shaped ridge to be slidable on said rail between latched and unlatched positions and having a longitudinal slot;

a fastener extending from said light housing through the longitudinal slot of said slide latch, said fastener having a head that is movable to engage said slide latch when said slide latch is in the latched position;

a projection on the other one of said front and rear housing parts, wherein said projection is proximate said slide latch when said front and rear housing parts are adjacent each other to define said light housing;

wherein when said front and rear housing parts are adjacent each other and said slide latch is moved to the latched position, said slide latch engages said projection, thereby to prevent separation of said front and rear housing parts, and wherein when said fastener is not secured by said fastener and said slide latch is moved to the unlatched position, said slide latch disengages from said projection, thereby to release said front and rear housing parts to be separated.

37. The portable light of claim 36 wherein the one or more lenses include a clear lens, a diffusing lens, a color filter, an optical filter, or a combination thereof.

38. The portable light of claim 36 wherein said rear housing part is pivotably mounted to a base:

wherein said base is shaped to generally conform with an object to which said portable light is intended to be mounted; or wherein said base has a plurality of slots for receiving a band or strap; or wherein said base has a pad or cushion on a surface thereof remote from said light housing; or any combination of the foregoing.

* * * * *